US009221254B2

(12) United States Patent
Domae

(10) Patent No.: US 9,221,254 B2
(45) **Date of Patent: *Dec. 29, 2015**

(54) LIQUID JET HEAD, LIQUID JET APPARATUS AND METHOD OF MANUFACTURING LIQUID JET HEAD

(71) Applicant: SII PRINTEK INC., Chiba-shi, Chiba (JP)

(72) Inventor: Yoshinori Domae, Chiba (JP)

(73) Assignee: SII PRINTEK INC. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/332,801

(22) Filed: Jul. 16, 2014

(65) Prior Publication Data

US 2015/0029269 A1 Jan. 29, 2015

(30) Foreign Application Priority Data

Jul. 24, 2013 (JP) ..... 2013-153888

(51) Int. Cl.
*B41J 2/045* (2006.01)
*B41J 2/14* (2006.01)
*B41J 2/16* (2006.01)

(52) U.S. Cl.
CPC ..... *B41J 2/14201* (2013.01); *B41J 2/14209* (2013.01); *B41J 2/1607* (2013.01); *B41J 2/1609* (2013.01); *B41J 2/1623* (2013.01); *B41J 2/1631* (2013.01); *B41J 2/1632* (2013.01); *B41J 2002/14411* (2013.01); *B41J 2202/12* (2013.01)

(58) Field of Classification Search
None
See application file for complete search history.

(56) References Cited

U.S. PATENT DOCUMENTS

2004/0070655 A1 * 4/2004 Aoi et al. ..... 347/100

FOREIGN PATENT DOCUMENTS

| | | | |
|---|---|---|---|
| EP | 1923219 | | 5/2008 |
| EP | 1923219 | A2 * | 5/2008 |
| GB | 2498094 | | 7/2013 |
| JP | 07205422 | | 8/1995 |
| JP | 08258261 | | 10/1996 |
| JP | 10086369 | | 4/1998 |
| JP | 11314362 | | 11/1999 |
| JP | 2009500209 | | 1/2009 |
| WO | 2012144597 | | 10/2012 |

OTHER PUBLICATIONS

IPO Search Report mailed Nov. 14, 2014 issued in Appln. No. EP 14 17 8378.

* cited by examiner

*Primary Examiner* — Erica Lin
(74) *Attorney, Agent, or Firm* — Adams & Wilks

(57) ABSTRACT

The liquid jet head is provided with a piezoelectric substrate having a plurality of groove rows in each of which elongated ejection grooves and elongated non-ejection grooves are alternately arranged in a reference direction. The groove rows are arranged next to one another in the longitudinal direction of the grooves, and in adjacent ones of the groove rows, the right ends of ejection grooves included in a groove row located on a left side and the left ends of non-ejection grooves included in a groove row located on the right side are separated from each other, and overlap each other in a thickness direction of the piezoelectric substrate.

15 Claims, 18 Drawing Sheets

(S2-1)

(S2-2)

(S9-1)

(S9-2)

(S9-3)

LIQUID JET HEAD, LIQUID JET APPARATUS AND METHOD OF MANUFACTURING LIQUID JET HEAD

BACKGROUND

1. Technical Field

The present invention relates to a liquid jet head which jets liquid droplets onto a recording medium to perform recording, a liquid jet apparatus, and a method of manufacturing a liquid jet head.

2. Related Art

Recently, there has been used a liquid jet head of an ink jet system that ejects ink droplets onto a recording paper or the like to record characters or figures thereon, or ejects a liquid material onto the surface of an element substrate to form a functional thin film thereon. In the ink jet system, liquid such as ink or a liquid material is guided from a liquid tank into a channel through a supply path, and pressure is applied to liquid filled in the channel to thereby eject the liquid from a nozzle that communicates with the channel. When ejecting liquid, characters or figures are recorded, or a functional thin film having a predetermined shape is formed by moving the liquid jet head and a recording medium.

FIGS. 18A and 18B illustrate a liquid jet head of this type described in JP 2009-500209 W. FIG. 18A is a schematic cross-sectional view of a channel portion. FIG. 18B is a perspective view of the channel portion from which a nozzle plate is removed. Discharge channels 1508 and non-discharge channels 1510 are partitioned by operation side walls 1507 and alternately arranged on a base 1502. Channel extending areas 1504 are formed above the discharge channels 1508 in continuous from the respective discharge channels 1508. The discharge channels 1508 and the non-discharge channels 1510 are alternately open up and down through the channel extending areas 1504. A nozzle plate 1505 on which nozzles 1506 are open is adhered above the channel extending areas 1504. That is, the illustrated liquid jet head is a side shooter liquid jet head which discharges liquid droplets from the discharge channels 1508 in a direction perpendicular to the surface of the base 1502. Liquid such as ink is filled so as to circulate from one side toward the other side in the longitudinal direction of each of the channels. Electrodes 1511 are formed on the surfaces of the operation side walls 1507 which partition the discharge channels 1508 and the non-discharge channels 1510. A drive signal is applied to the electrodes 1511 to operate the operation side walls 1507 to apply pressure to ink inside the discharge channels 1508, thereby ejecting ink droplets from the nozzles 1506.

As with JP 2009-500209 W described above, in JP 7-205422 A, JP 8-258261 A, JP 11-314362 A, and JP 10-86369 A, there is described a liquid jet head in which grooves which serve as channels are alternately open up and down in the longitudinal direction of the channels. In JP 7-205422 A, JP 8-258261 A, JP 11-314362 A, and JP 10-86369 A, there is described an edge shooter liquid jet head which includes a channel row having channels arranged in a row in a direction perpendicular to the longitudinal direction of each of the channels, and discharges liquid droplets from an end on one side in the longitudinal direction of each discharge channel.

JP 2009-500209 W describes a channel row having channels arranged in a row in a direction perpendicular to the longitudinal direction of each of the channels. However, there is no description regarding forming a plurality of channel rows or forming a plurality of channel rows with narrow intervals so as to have high density. Also in JP 7-205422 A, JP 8-258261 A, JP 11-314362 A, and JP 10-86369 A, there is no description regarding forming a plurality of channel rows or forming a plurality of channel rows with narrow intervals.

Further, in the liquid jet head described in JP 2009-500209 W, liquid is filled into both of the discharge channel 1508 and the non-discharge channel 1510. Therefore, liquid makes contact with the surfaces of electrodes of both of the channels. Therefore, when conductive ejection liquid is used, it is necessary to place a protection film or the like on the surfaces of the electrodes 1511 and the base 1502, which results in complicated and long manufacturing process steps.

SUMMARY OF THE INVENTION

A liquid jet head of the present invention includes a piezoelectric substrate having a plurality of groove rows in each of which elongated ejection grooves and elongated non-ejection grooves are alternately arranged in a reference direction, wherein, in adjacent ones of the groove rows, ends on a second side of ejection grooves included in a groove row located on a first side and ends on the first side of non-ejection grooves included in a groove row located on the second side are separated from each other, and overlap each other in a thickness direction of the piezoelectric substrate.

Further, in adjacent ones of the groove rows, ends on the second side of ejection grooves included in a groove row located on the first side and ends on the first side of ejection grooves included in a groove row located on the second side overlap each other in the reference direction.

Further, in adjacent ones of the groove rows, ends on the second side of non-ejection grooves included in a groove row located on the first side and ends on the first side of non-ejection grooves included in a groove row located on the second side overlap each other in the reference direction.

Further, in adjacent ones of the groove rows, ends on the second side of ejection grooves included in a groove row located on the first side include inclined surfaces inclined outward toward an upper surface of the piezoelectric substrate, and ends on the second side of non-ejection grooves included in the groove row located on the first side include inclined surfaces inclined outward toward a lower surface opposite to the upper surface of the piezoelectric substrate.

Further, in adjacent ones of the groove rows, ends on the first side of non-ejection grooves included in a groove row located on the first side are open on a side surface of the piezoelectric substrate.

Further, the closest distance between ends on the second side of ejection grooves included in a groove row located on the first side and ends on the first side of non-ejection grooves included in a groove row located on the second side is not less than 10 μm.

Further, the liquid jet head further includes a cover plate having a liquid chamber communicating with the ejection grooves, the cover plate being bonded to the upper surface of the piezoelectric substrate.

Further, the liquid jet head further includes a nozzle plate having a plurality of nozzle arrays in each of which nozzles communicating with the ejection grooves are arrayed corresponding to the groove rows, the nozzle plate being bonded to a lower surface of the piezoelectric substrate.

Further, the liquid chamber includes a common liquid chamber communicating with ends on the second side of ejection grooves included in a groove row located on the first side.

Further, the liquid chamber includes an individual liquid chamber communicating with ends on the first side of the ejection grooves included in the groove row located on the first side.

Further, drive electrodes are formed on side surfaces of the ejection grooves and the non-ejection grooves not in a part between a position corresponding to approximately ½ of the thickness of the piezoelectric substrate and an upper surface, but in a part between the position corresponding to approximately ½ of the thickness of the piezoelectric substrate and a lower surface.

Further, drive electrodes formed on the ejection grooves are positioned within an area of opening portions in which the ejection grooves are open on the lower surface of the piezoelectric substrate in the groove direction.

Further, drive electrodes are formed on side surfaces of the ejection grooves and the non-ejection grooves not in a part between a position corresponding to approximately ½ of the thickness of the piezoelectric substrate and a lower surface, but in a part between the position corresponding to approximately ½ of the thickness of the piezoelectric substrate and an upper surface.

Further, drive electrodes formed on the non-ejection grooves are positioned within an area of opening portions in which the non-ejection grooves are open on the upper surface of the piezoelectric substrate in the groove direction.

A liquid jet apparatus according to an embodiment of the present invention includes the liquid jet head described above; a movement mechanism configured to relatively move the liquid jet head and a recording medium; a liquid supply tube configured to supply liquid to the liquid jet head; and a liquid tank configured to supply the liquid to the liquid supply tube.

A method of manufacturing a liquid jet head of the preset invention includes: an ejection groove forming step for cutting a piezoelectric substrate from an upper surface of the piezoelectric substrate using a dicing blade to form a plurality of elongated ejection grooves; and a non-ejection groove forming step for cutting the piezoelectric substrate from a lower surface opposite to the upper surface of the piezoelectric substrate using a dicing blade to form a plurality of elongated non-ejection grooves in parallel to a groove direction of the ejection grooves, wherein a plurality of groove rows in each of which ejection grooves and non-ejection grooves are alternately arranged in a reference direction are formed, and, in adjacent ones of the groove rows, ends on a second side of ejection grooves included in a groove row located on a first side and ends on the first side of non-ejection grooves included in a groove row located on the second side are separated from each other, and overlap each other in a thickness direction of the piezoelectric substrate.

Further, the method further includes a cover plate bonding step for bonding a cover plate in which a common liquid chamber is formed to the upper surface of the piezoelectric substrate so as to allow the common liquid chamber to communicate with the ejection grooves.

Further, the method further includes a nozzle plate bonding step for bonding a nozzle plate to the lower surface of the piezoelectric substrate to allow nozzles formed on the nozzle plate and the ejection grooves to communicate with each other.

Further, the method further includes a piezoelectric substrate grinding step for grinding the piezoelectric substrate so as to have a predetermined thickness after the ejection groove forming step.

Further, the method further includes a photosensitive resin film placing step for placing a photosensitive resin film on the piezoelectric substrate and a resin film pattern forming step for forming a pattern of the photosensitive resin film.

Further, the method further includes a conductive material depositing step for depositing a conductive material on side surfaces of the ejection grooves and the non-ejection grooves from the lower surface of the piezoelectric substrate.

Further, the method further includes a conductive material depositing step for depositing a conductive material on side surfaces of the ejection grooves and the non-ejection grooves from the upper surface of the piezoelectric substrate.

The liquid jet head according to the present invention is provided with a piezoelectric substrate that has a plurality of groove rows in each of which elongated ejection grooves and elongated non-ejection grooves are alternately arranged in a reference direction. In adjacent ones of the groove rows, ends on a second side of ejection grooves included in a groove row located on a first side and ends on the first side of non-ejection grooves included in a groove row located on the second side are separated from each other, and overlap each other in the thickness direction of the piezoelectric substrate. Accordingly, it is possible to arrange the ejection grooves in high density, and increase the number of piezoelectric substrates obtained from a single piezoelectric wafer. Further, the structure of the cover plate bonded to the upper surface of the piezoelectric substrate can be simplified.

DETAILED DESCRIPTION OF THE INVENTION

First Embodiment

Figure 1:
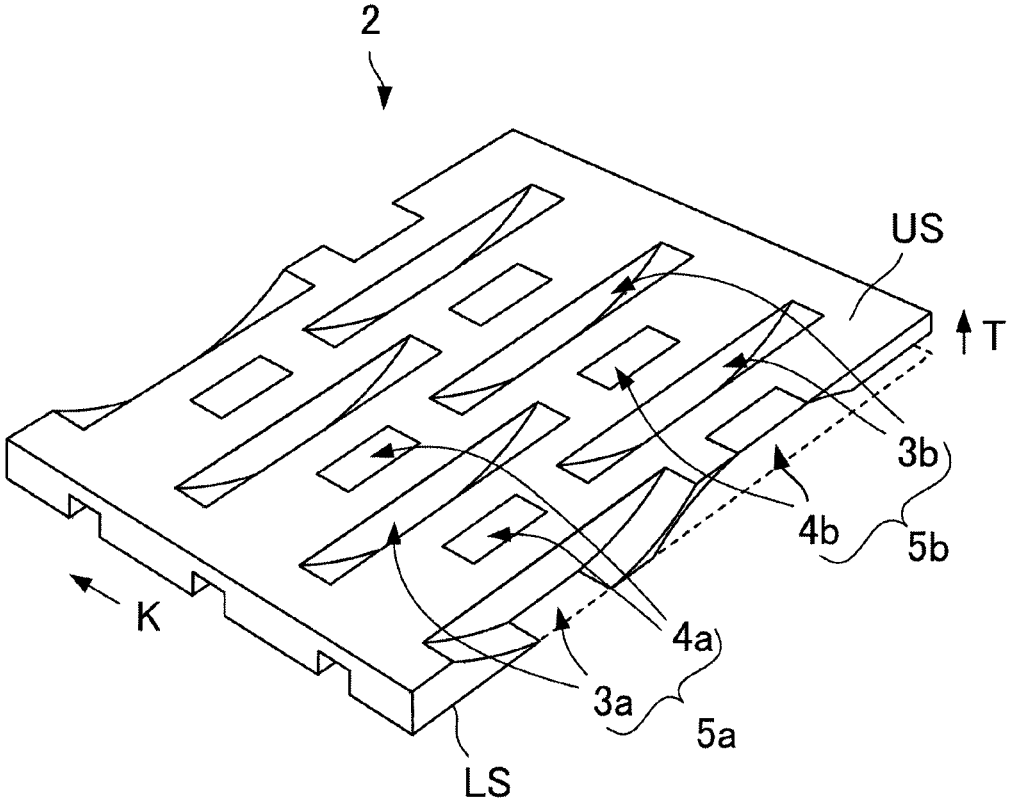
FIG. 1 is a schematic perspective view of a piezoelectric substrate of a liquid jet head according to a first embodiment of the present invention.
Figure 2A:
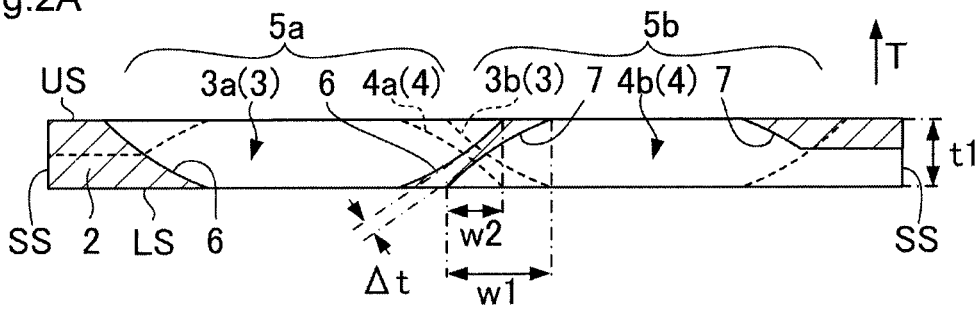
FIGS. 2A to 2C are explanatory drawings of the piezoelectric substrate of the liquid jet head according to the first embodiment of the present invention.
Figure 2B:
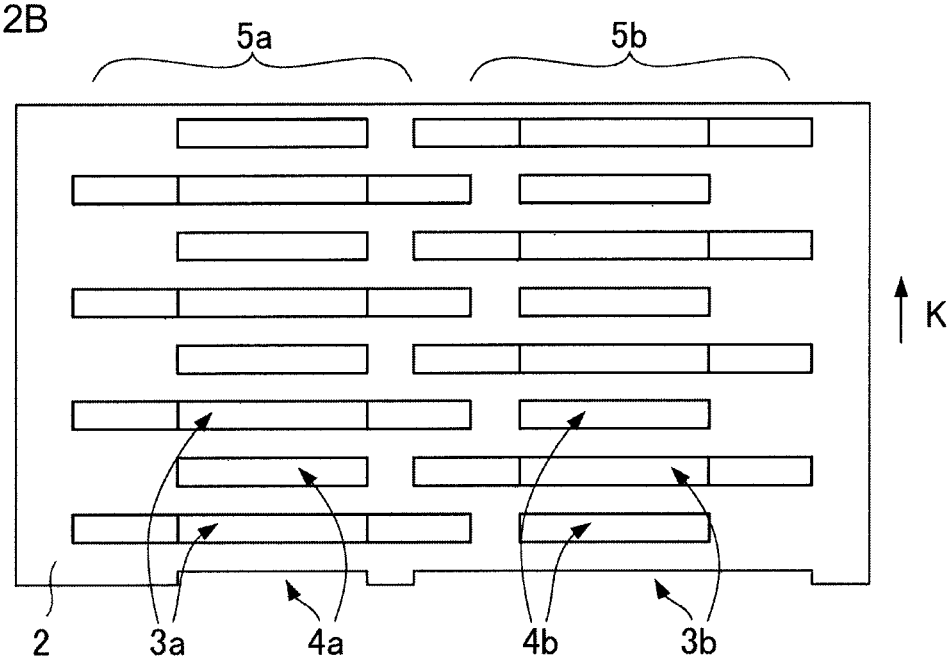
Figure 2C:
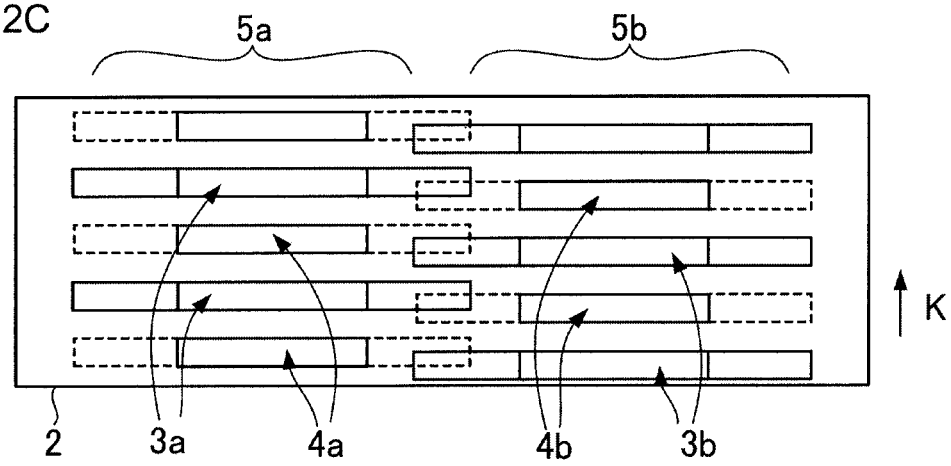

FIG. 1 is a schematic perspective view of a piezoelectric substrate 2 of a liquid jet head 1 according to the first embodiment of the present invention. FIGS. 2A to 2C are explanatory drawings of the piezoelectric substrate 2 of the liquid jet head 1 according to the first embodiment of the present invention. FIG. 2A is a schematic cross-sectional view of the piezoelectric substrate 2 in a groove direction. FIG. 2B is a partial schematic top view of the piezoelectric substrate 2. FIG. 2C is a partial schematic top view of a modified example of the piezoelectric substrate 2. A cover plate is bonded to an upper surface US of the piezoelectric substrate 2, and a nozzle plate is bonded to a lower surface LS of the piezoelectric substrate 2 to thereby form the liquid jet head 1. In the first embodiment, the piezoelectric substrate 2 which is a basic element of the present invention will be described.

As illustrated in FIG. 1, the piezoelectric substrate 2 is provided with a first groove row 5*a* in which elongated first ejection grooves 3*a* and elongated first non-ejection grooves 4*a* are alternately arranged in a reference direction K and a second groove row 5*b* in which elongated second ejection grooves 3*b* and elongated second non-ejection grooves 4*b* are alternately arranged in the reference direction K, the first groove row 5*a* and the second groove row 5*b* being adjacent to each other. In the adjacent first and second groove rows 5*a* and 5*b*, ends on a second side (hereinbelow, also referred to as second ends) of the first ejection grooves 3*a* included in the first groove row 5*a* located on a first side and ends on the first side (hereinbelow, also referred to as first ends) of the second non-ejection grooves 4*b* included in the second groove row 5*b* located on the second side are separated from each other, and overlap each other in a thickness direction T of the piezoelectric substrate 2. Similarly, in the adjacent first and second groove rows 5*a* and 5*b*, ends on the first side (hereinbelow, also referred to as first ends) of the second ejection grooves 3*b* included in the second groove row 5*b* located on the second side and ends on the second side (hereinbelow, also referred to as second ends) of the first non-ejection grooves 4*a* included in the first groove row 5*a* located on the first side are separated from each other, and overlap each other in the thickness direction T of the piezoelectric substrate 2.

The distance between the first groove row 5*a* and the second groove row 5*b* which are adjacent to each other can be reduced by allowing the first ejection grooves 3*a* or the second ejection grooves 3*b* of the first groove row 5*a* and the second groove row 5*b* and the second non-ejection grooves 4*b* or the first non-ejection grooves 4*a* of the first groove row 5*a* and the second groove row 5*b* to have the above configuration. Accordingly, the ejection grooves can be arranged in high density, and the number of piezoelectric substrates 2 obtained from a single piezoelectric wafer can be increased to achieve cost reduction.

Detailed description will be made with reference to FIGS. 2A to 2C. FIG. 2A illustrates the cross-sectional shape of a first ejection groove 3*a* of the first groove row 5*a* and the cross-sectional shape of a second non-ejection groove 4*b* of the second groove row 5*b*. A first non-ejection groove 4*a* of the first groove row 5*a* and a second ejection groove 3*b* of the second groove row 5*b* adjacent in the reference direction K (a depth direction of the sheet) are indicated by broken lines. As the piezoelectric substrate 2, lead zirconate titanate (PZT) ceramics can be used. In the piezoelectric substrate 2, at least side walls each of which functions as a drive wall are only required to be made of a piezoelectric material. Even when a non-piezoelectric material is used in a peripheral area in which the ejection grooves 3 and the non-ejection grooves 4 are not formed and an area corresponding to a liquid chamber 9 of a cover plate 8, the substrate 2 is referred to as a piezoelectric substrate in the following description. Each of the grooves is formed by performing cutting using a dicing blade (also referred to as a diamond blade) which is a disk having abrasive grains such as diamond embedded on the periphery thereof. The first ejection grooves 3*a* and the second ejection grooves 3*b* are formed by cutting the piezoelectric substrate 2 from the upper surface US toward the lower surface LS. The first non-ejection grooves 4*a* and the second non-ejection grooves 4*b* are formed by cutting the piezoelectric substrate 2 from the lower surface LS toward the upper surface US. Therefore, each of the first and second ejection grooves 3*a* and 3*b* has a projection shape projecting from the upper surface US toward the lower surface LS. On the other hand, each of the first and second non-ejection grooves 4*a* and 4*b* has a projection shape projecting from the lower surface LS toward the upper surface US.

All of the first and second ejection grooves 3*a* and 3*b* and the first and second non-ejection grooves 4*a* and 4*b* penetrate the piezoelectric substrate 2 from the upper surface US through the lower surface LS. In the present invention, it is essential that the first and second non-ejection grooves 4*a* and 4*b* be open on the lower surface LS. However, it is not essential that the first and second non-ejection grooves 4*a* and 4*b* be open on the upper surface US. In each of the first and second ejection grooves 3*a* and 3*b*, an opening on the upper surface US is wider than an opening on the lower surface LS. Similarly, in each of the first and second non-ejection grooves 4*a* and 4*b*, an opening on the lower surface LS is wider than an opening on the upper surface US. Specifically, both ends of each of the first and second ejection grooves 3*a* and 3*b* have inclined surfaces 6 which are inclined outward from the lower surface LS toward the upper surface US of the piezoelectric substrate 2. On the other hand, both ends of each of the first and second non-ejection grooves 4*a* and 4*b* have inclined surfaces 7 which are inclined outward from the upper surface US toward the lower surface LS of the piezoelectric substrate 2.

As illustrated in FIG. 2B, the piezoelectric substrate 2 is provided with the first groove row 5*a* and the second groove row 5*b* which are in parallel to each other in the reference direction K. The first ejection grooves 3*a* and the first non-ejection grooves 4*a* are alternately arranged at equal intervals in the reference direction K. The second ejection grooves 3*b* and the second non-ejection grooves 4*b* are alternately arranged at equal intervals in the reference direction K so as to be deviated by a half pitch from the arrangement of the first groove row 5*a*. In other words, each of the first ejection grooves 3*a* of the first groove row 5*a* and the corresponding second non-ejection groove 4*b* of the second groove row 5*b* are linearly arranged in the groove direction. On the other hand, each of the first non-ejection grooves 4*a* of the first groove row 5*a* and the corresponding second ejection groove 3*b* of the second groove row 5*b* are linearly arranged in the groove direction.

As illustrated in FIG. 2A, the second end of the first ejection groove 3*a* and the first end of the second non-ejection groove 4*b*, the second end and the first end being located on the adjacent side, that is, the inclined surface 6 of the first ejection groove 3*a* and the inclined surface 7 of the second non-ejection groove 4*b* on the adjacent side are separated from each other, and overlap each other in the thickness direction T by a length w2 of the overlapping portion in the groove direction. Similarly, the second end of the first non-ejection groove 4*a* and the first end of the second ejection groove 3*b*, the first end and the second end being located on the adjacent side, that is, the inclined surface 7 of the first non-ejection groove 4*a* and the inclined surface 6 of the second ejection groove 3*b* on the adjacent side are separated from each other, and overlap each other in the thickness direction T by the length w2 of the overlapping portion in the groove direction. Accordingly, it is possible to narrow a space between the first groove row 5*a* and the second groove row 5*b* without causing the first ejection grooves 3*a* and the second non-ejection grooves 4*b* to communicate with each other and the second ejection grooves 3*b* and the first non-ejection grooves 4*a* to communicate with each other.

The closest distance Δt between the second ends of the first ejection grooves 3*a* included in the first groove row 5*a* located on the first side and the first ends of the second non-ejection grooves 4*b* included in the second groove row 5*b* located on the second side is preferably 10 μm or more. When the closest distance Δt is less than 10 μm, the first ejection grooves 3*a* and the second non-ejection grooves 4*b* may communicate with each other through a void existing within the piezoelectric substrate 2. Therefore, in order to prevent such a situation, the closest distance Δt is set to 10 μm or more. Similarly, the closest distance between the first ends of the second ejection grooves 3*b* included in the second groove row 5*b* located on the second side and the second ends of the first non-ejection groove 4*a* included in the first groove row 5*a* located on the first side is also preferably 10 μm or more.

Further, for example, the shape of the first and second ejection grooves 3*a* and 3*b* and the shape of the first and second non-ejection groove 4*a* and 4*b* are formed in vertically-inverted shapes. Further, the thickness t1 of the piezoelectric substrate 2, that is, the depth of each of the first and second ejection grooves 3*a* and 3*b* and the first and second non-ejection grooves 4*a* and 4*b* is, for example, 360 μm. For example, when cutting the piezoelectric substrate 2 to form each of the grooves using a dicing blade having a radius of 25.7 mm, the length w1 in the groove direction of each of the inclined surfaces 6 and 7 is approximately, 3.5 mm, and the length w2 in the groove direction of the overlapping portion in which the ejection groove 3 and the non-ejection groove 4 overlap each other in the thickness direction T without communicating with each other is approximately 2 mm. That is, the distance between the first groove row 5*a* and the second groove row 5*b* can be reduced by at least 2 mm. Similarly, when the thickness t1 of the piezoelectric substrate 2 (the depth of the grooves) is 300 μm, the length w1 of each of the inclined surfaces 6 and 7 is appropriately 3.1 mm, and the length w2 of the overlapping portion in the groove direction is approximately 1.7 mm. Therefore, the distance between the first groove row 5*a* and the second groove row 5*b* can be reduced by at least 1.7 mm. When considering formation of electrode terminals on the upper surface US and the lower surface LS of the piezoelectric substrate 2, a larger reduction effect can be obtained.

Further, as illustrated in FIGS. 2A and 2B, in the adjacent first and second groove rows 5*a* and 5*b*, the second ends of the first ejection grooves 3*a* included in the first groove row 5*a* located on the first side and the first ends of the second ejection grooves 3*b* included in the second groove row 5*b* located on the second side overlap each other in the reference direction K. Similarly, in the adjacent first and second groove rows 5*a* and 5*b*, the second ends of the first non-ejection grooves 4*a* included in the first groove row 5*a* located on the first side and the first ends of the second non-ejection grooves 4*b* included in the second groove row 5*b* located on the second side overlap each other in the reference direction K. Further, the first and second non-ejection grooves 4*a* and 4*b* are not open in the overlapping area in the reference direction K.

As a result, the liquid chamber of the cover plate (described below) is commonly used between the first groove row 5*a* and the second groove row 5*b*. Further, since the first non-ejection grooves 4*a* and the second non-ejection grooves 4*b* are not open in the overlapping area, even if no slit is provided on the liquid chamber of the cover plate, liquid does not flow into the first and second non-ejection grooves 4*a* and 4*b*. Therefore, the structure of the cover plate can be simplified.

Further, as illustrated in FIG. 2A, in the adjacent first and second groove rows 5*a* and 5*b*, ends on the first side (first ends) of the first non-ejection grooves 4*a* included in the first groove row 5*a* located on the first side are open on a side surface SS of the piezoelectric substrate 2. Further, ends on the second side (second ends) of the second non-ejection grooves 4*b* included in the second groove row 5*b* located on the second side are open on the side surface SS of the piezoelectric substrate 2. Since liquid is not filled in the first and second non-ejection grooves 4*a* and 4*b*, the first and second non-ejection grooves 4*a* and 4*b* can be configured to communicate with the air. In particular, the depth from the lower surface LS of each of the first and second non-ejection grooves 4*a* and 4*b* on the side opposite to the adjacent side is preferably deeper than approximately ½ of the thickness t1 of the piezoelectric substrate 2. Accordingly, it is possible to electrically separate drive electrodes formed on both side walls of the first non-ejection groove 4*a* or the second non-ejection groove 4*b* and extract the drive electrodes to the outer peripheral side of the piezoelectric substrate 2.

Providing the first and second non-ejection grooves 4*a* and 4*b* so as to extend up to the side surface SS is not an essential requirement of the present invention. The first and second non-ejection grooves 4*a* and 4*b* may not extend up to the side surface SS, and may have a vertically inverted shape of the first and second ejection grooves 3*a* and 3*b*. Further, although a case where the adjacent two groove rows are formed has been described above, the present invention is not limited thereto. The number of groove rows may be three or more.

Further, the present invention is not limited to the configuration in which the grooves of the first groove row 5*a* are deviated by a half pitch in the reference direction K from the respective grooves of the second groove row 5*b*. It is only required that, in the adjacent first and second groove rows 5*a* and 5*b*, the second ends of the first ejection grooves 3*a* included in the first groove row 5*a* located on the first side and the first ends of the second non-ejection grooves 4*b* included in the second groove row 5*b* located on the second side are separated from each other, and overlap each other in the thickness direction T of the piezoelectric substrate 2. Similarly, it is only required that the first ends of the second ejection grooves 3*b* included in the second groove row 5*b* located on the second side and the second ends of the first non-ejection grooves 4*a* included in the first groove row 5*a* located on the first side are separated from each other, and overlap each other in the thickness direction T of the piezoelectric substrate 2. In a modified example illustrated in FIG. 2C, the first groove row 5*a* and the second groove row 5*b* are deviated from each other by a ⅜ pitch in the reference direction K. Also in this case, as with the case where the first groove row 5*a* and the second groove row 5*b* are deviated from each other by a half pitch, it is possible to narrow the space between the first groove row 5*a* and the second groove row 5*b*. Further, the structure of the cover plate 8 can be simplified.

Second Embodiment

Figure 3:
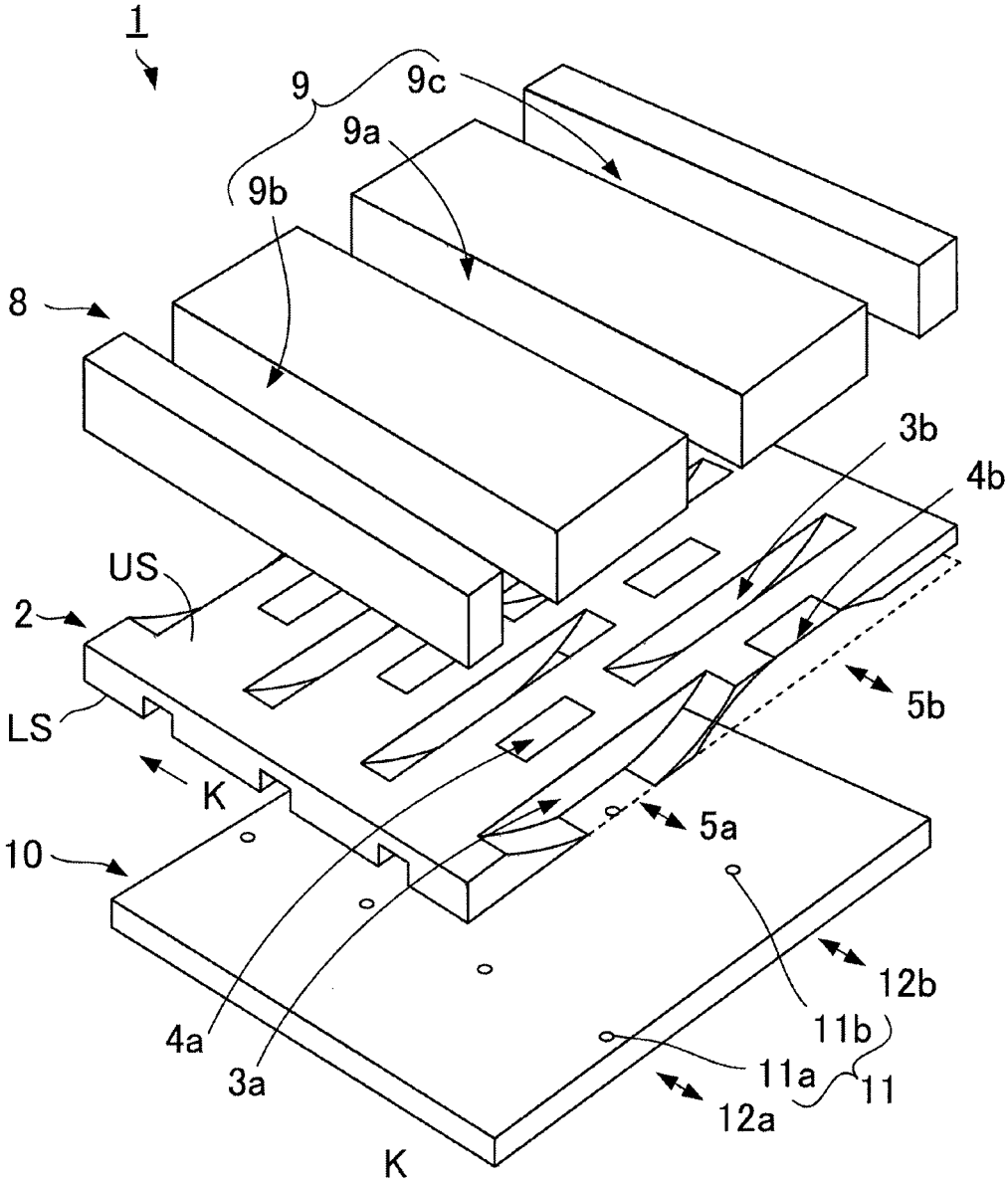
FIG. 3 is a schematic exploded perspective view of a liquid jet head according to a second embodiment of the present invention.
Figure 4A:
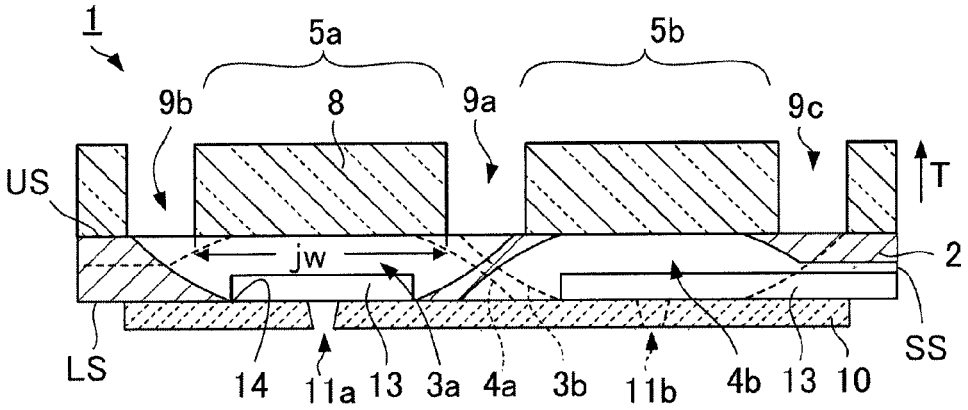
FIGS. 4A and 4B are explanatory drawings of the liquid jet head according to the second embodiment of the present invention.
Figure 4B:
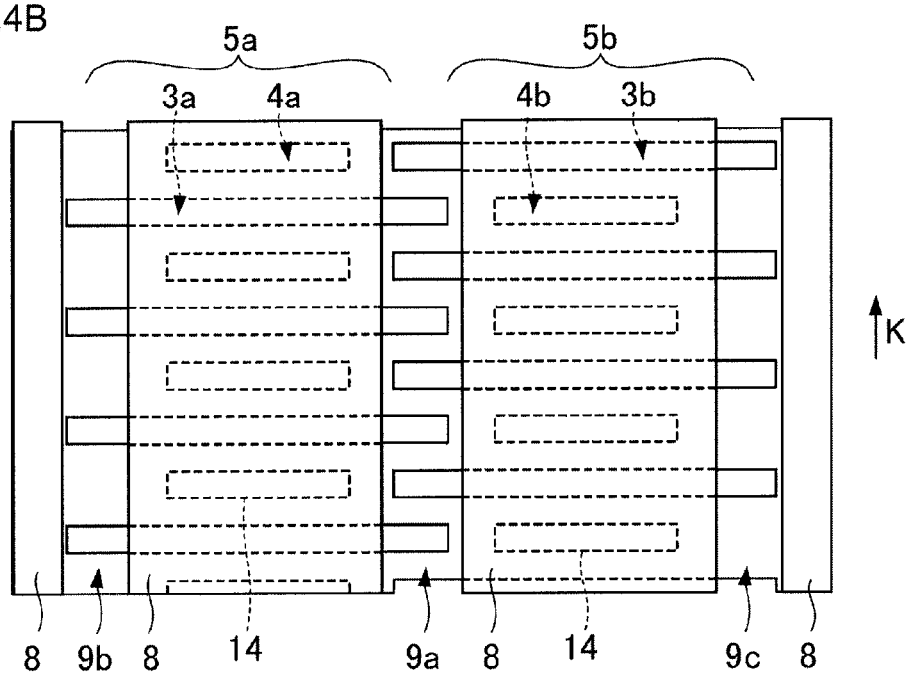
Figure 5:
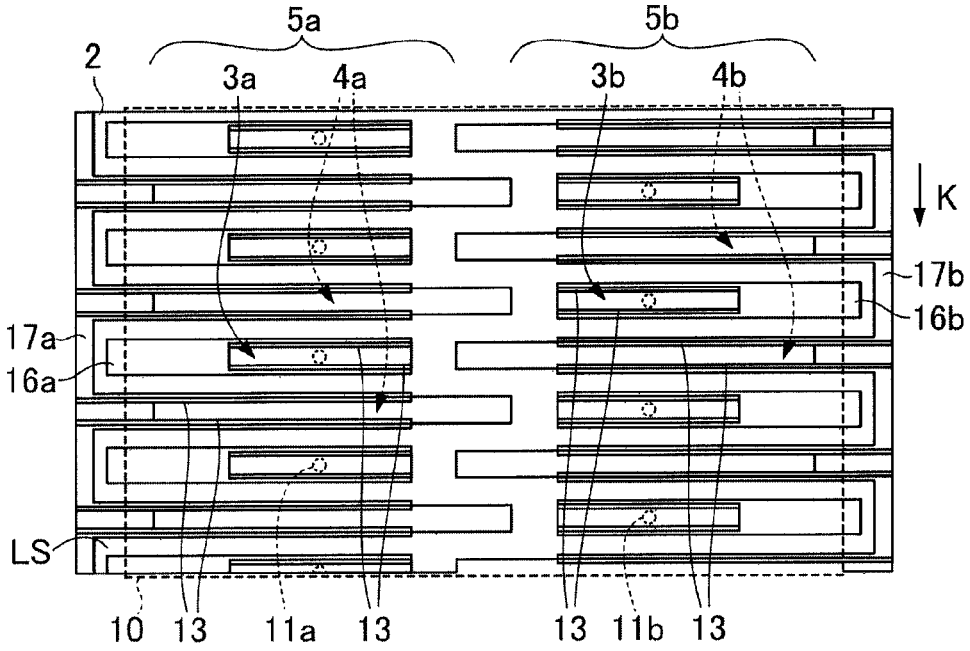
FIG. 5 is an explanatory drawing of the liquid jet head according to the second embodiment of the present invention.

FIG. 3 is a schematic exploded perspective view of a liquid jet head 1 according to the second embodiment of the present invention. FIGS. 4A, 4B, and 5 are explanatory drawings of the liquid jet head 1 according to the second embodiment of the present invention. FIG. 4A is a schematic cross-sectional view of the liquid jet head 1 in the groove direction. FIG. 4B is a partial schematic plan view of the liquid jet head 1 viewed from the normal direction of a cover plate 8. FIG. 5 is a partial schematic plan view of a lower surface LS of a piezoelectric substrate 2. A different point from the first embodiment is that the cover late 8 is placed on an upper surface US of the piezoelectric substrate 2, and a nozzle plate 10 is placed on the lower surface LS of the piezoelectric substrate 2. Since the piezoelectric substrate 2 has the same configuration as the piezoelectric substrate 2 of the first embodiment, detailed description thereof will be omitted. The same components or components having the same function are denoted by the same marks throughout the drawings.

As illustrated in FIG. 3, the liquid jet head 1 is provided with the piezoelectric substrate 2 which has a first groove row 5*a* and a second groove row 5*b*, the cover plate 8 which has a liquid chamber 9, and the nozzle plate 10 which has nozzles 11. The cover plate 8 has the liquid chamber 9 which communicates with first and second ejection grooves 3*a* and 3*b*, and is bonded to the upper surface US of the piezoelectric substrate 2. The nozzle plate 10 has a first nozzle array 12*a* in which nozzles 11*a* which communicate with the respective first ejection grooves 3*a* are arrayed corresponding to the first groove row 5*a* and a second nozzle array 12*b* in which nozzle 11*b* which communicate with the respective second ejection grooves 3*b* are arrayed corresponding to the second groove row 5*b*. The nozzle plate 10 is bonded to the lower surface LS of the piezoelectric substrate 2.

The liquid chamber 9 includes a common liquid chamber 9*a* and two individual liquid chambers 9*b*, 9*c*. The common liquid chamber 9*a* communicates with ends on the second side (second ends) of the first ejection grooves 3*a* included in the first groove row 5*a* located on the first side and ends on the first side (first ends) of the second ejection grooves 3*b* included in the second groove row 5*b* located on the second side. Further, the individual liquid chamber 9*b* communicates with ends on the first side (first ends) of the first ejection grooves 3*a* included in the first groove row 5*a* located on the first side. The individual liquid chamber 9*c* communicates with ends on the second side (second ends) of the second ejection grooves 3*b* included in the second groove row 5*b* located on the second side.

First and second non-ejection grooves 4*a* and 4*b* are not open in an overlapping area in which the first ejection grooves 3*a* and the second ejection grooves 3*b* overlap each other in the reference direction K. Therefore, it is not necessary to provide slits in the common liquid chamber 9*a* for allowing the common liquid chamber 9*a* and the first and second ejection grooves 3*a* and 3*b* to communicate with each other and blocking the first and second non-ejection grooves 4*a* and 4*b* with respect to the common liquid chamber 9*a*. The first ejection grooves 3*a* and the second non-ejection grooves 4*b* which overlap each other in the thickness direction T are separated from each other. Further, the second ejection grooves 3*b* and the first non-ejection grooves 4*a* which overlap each other in the thickness direction T are separated from each other. Therefore, liquid flowing into the common liquid chamber 9*a* flows through the first ejection grooves 3*a* and then flows out to the individual liquid chamber 9*b*, and flows through the second ejection grooves 3*b* and then flows out to the individual liquid chamber 9*c*, without flowing into the first and second non-ejection grooves 4*a* and 4*b*. Further, a part of the liquid flowing into the first and second ejection grooves 3*a* and 3*b* is ejected from the nozzles 11*a* communicating with the respective first ejection grooves 3*a* and the nozzles 11*b* communicating with the respective second ejection grooves 3*b*.

Further, as illustrated in FIG. 4A, the second ends facing the second groove row 5*b* of the first ejection grooves 3*a* and the first ends facing the first groove row 5*a* of the second ejection grooves 3*b* are preferably positioned within an area of an opening portion of the liquid chamber 9*a*, the opening portion facing the piezoelectric substrate 2. Similarly, the first ends opposite to the second groove row 5*b* of the first ejection grooves 3*a* are preferably positioned within an area of an opening portion of the individual liquid chamber 9*b*, the opening portion facing the piezoelectric substrate 2. Further, the second ends opposite to the first groove row 5*a* of the second ejection grooves 3*b* are preferably positioned within an area of an opening portion of the individual liquid chamber 9*c*, the opening portion facing the piezoelectric substrate 2. Accordingly, liquid pools in internal areas of the first and second ejection grooves 3*a* and 3*b* and flow paths of the common liquid chamber 9*a* and the individual liquid chambers 9*b* and 9*c* are reduced, which makes it possible to reduce accumulation of air bubbles.

Drive electrodes 13 are formed on side surfaces of the first and second ejection grooves 3*a* and 3*b* and the first and second non-ejection grooves 4*a* and 4*b* not in a part between a position corresponding to approximately ½ of the thickness of the piezoelectric substrate 2 and the upper surface US, but in a part between the position corresponding to approximately ½ of the thickness of the piezoelectric substrate 2 and the lower surface LS. In particular, drive electrodes 13 that are formed on the side surfaces of each of the first ejection grooves 3*a* or the second ejection grooves 3*b* are positioned within an area of an opening portion 14 of each of the first ejection grooves 3*a* or the second ejection grooves 3*b*, the opening portion 14 being open on the lower surface LS, in the groove direction. Further, drive electrodes 13 that are formed on both side surfaces of each of the first and second non-ejection grooves 4*a* and 4*b* are electrically separated from each other and extend up to the side surface SS of the piezoelectric substrate 2.

In the present embodiment, an example in which the piezoelectric substrate 2 which is uniformly polarized in a direction perpendicular to the upper surface US or the lower surface LS is used, and the drive electrodes 13 are formed on the lower half of the grooves is described. Alternatively, a chevron type piezoelectric substrate 2 obtained by adhering together a piezoelectric substrate which is polarized in the direction perpendicular to the upper surface US or the lower surface LS and a piezoelectric substrate which is polarized in the opposite direction thereto can be used. In this case, the drive electrodes 13 can be formed on the side surfaces from a position above the polarization boundary to the lower surface LS.

As illustrated in FIG. 5, the first non-ejection grooves 4*a* of the first groove row 5*a* extend up to an end of the piezoelectric substrate 2, the end being opposite to the second groove row 5*b*. Drive electrodes 13 formed on the side surfaces of each of the first non-ejection grooves 4*a* are electrically separated from each other, and extend up to the end of the piezoelectric substrate 2. Similarly, the second non-ejection grooves 4*b* of the second groove row 5*b* extend up to an end of the piezoelectric substrate 2, the end being opposite to the first groove row 5*a*. Drive electrodes 13 formed on the side surfaces of each of the second non-ejection grooves 4*b* are electrically separated from each other, and extend up to the end of the piezoelectric substrate 2. On the lower surface LS of the piezoelectric substrate 2, there are placed first common terminals 16*a* which are electrically connected to the drive electrodes 13 formed on the side surfaces of the first ejection grooves 3*a* and first individual terminals 17*a* which are electrically connected to the drive electrodes 13 of the first non-ejection grooves 4*a*. Further, on the lower surface LS of the piezoelectric substrate 2, there are placed second common terminals 16*b* which are electrically connected to the drive electrodes 13 of the second ejection grooves 3*b* and second individual terminals 17*b* which are electrically connected to the drive electrodes 13 of the second non-ejection grooves 4*b*. The first common terminals 16*a* and the first individual terminals 17*a* are placed near the end on the first side of the lower surface LS of the piezoelectric substrate 2. The second common terminals 16*b* and the second individual terminals 17*b* are placed near the end on the second side of the lower surface LS. These first and second common terminals 16*a* and 16*b* and the first and second individual terminals 17*a* and 17*b* are connected to a flexible circuit board (not illustrated), and a drive signal is applied thereto.

More specifically, in the first groove row 5*a*, drive electrodes 13 formed on both side surfaces of each of the first ejection grooves 3*a* are connected to the corresponding first common terminal 16*a*. Further, drive electrodes 13 formed on side surfaces of two first non-ejection grooves 4*a* between which a first ejection groove 3*a* is interposed, the side surfaces facing the first ejection groove 3*a*, are electrically connected to each other through the corresponding first individual terminal 17*a*. The first individual terminals 17*a* are placed on the lower surface LS at the end facing the first groove row 5*a* of the piezoelectric substrate 2. The first common terminals 16*a* are placed on the lower surface LS at positions between the first individual terminals 17*a* and the first ejection grooves 3*a*. Also in the second groove row 5*b*, the second common terminals 16*b* and the second individual terminals 17*b* are arranged in the same manner as the first common terminals 16*a* and the first individual terminals 17*a*.

In the present embodiment, the first and second common terminals 16*a* and 16*b* and the first and second individual terminals 17*a* and 17*b* are placed on the lower surface LS of the piezoelectric substrate 2, and connected to the flexible circuit board (not illustrated) so that a drive signal can be supplied thereto. However, the present invention is not limited to such a configuration. For example, the nozzle plate 10 may also serve as a flexible circuit board, and a drive signal may be applied through the nozzle plate 10.

Further, an area in the groove direction in which the cover plate 8 and the upper surface US of the piezoelectric substrate 2 are bonded to each other between the common liquid chamber 9*a* and the individual liquid chamber 9*b* or 9*c* is referred to as a bonded area jw (see FIG. 4A). Preferably, the drive electrodes 13 formed on the side surfaces of the first ejection grooves 3*a* or the second ejection grooves 3*b* correspond to the bonded area jw, or are included in the bonded area jw in the groove direction. Accordingly, pressure waves can be efficiently induced in liquid inside the first ejection grooves 3*a* or the second ejection grooves 3*b*.

The liquid jet head 1 is driven in the following manner. Liquid supplied to the common liquid chamber 9*a* flows into the first and second ejection grooves 3*a* and 3*b* to be filled in the first and second ejection grooves 3*a* and 3*b*. Further, the liquid flows from the first ejection grooves 3*a* into the individual liquid chamber 9*b* and from the second ejection grooves 3*b* into the individual liquid chamber 9*c* to be circulated. The piezoelectric substrate 2 is previously polarized in the thickness direction T. For example, when liquid droplets are ejected from the nozzles 11*a* which communicate with the respective first ejection grooves 3*a*, a drive signal is applied to the drive electrodes 13 on the side walls of the first ejection grooves 3*a* to cause the side walls to thickness-shear deform to thereby change the capacity of the first ejection grooves 3*a*. Accordingly, liquid droplets are ejected from the first nozzles 11*a* communicating with the respective first ejection grooves 3*a*. More specifically, the drive signal is applied between the first common terminals 16*a* and the first individual terminals 17*a* to cause the side walls of the first ejection grooves 3*a* to thickness-shear deform. Practically, the first common terminals 16*a* are fixed to a GND level potential, and the drive signal is applied to the first individual terminals 17*a*. Liquid may be circulated so as to flow from the individual liquid chambers 9*b* and 9*c* and flow out from the common liquid chamber 9*a*, or may also be supplied from all of the common liquid chamber 9*a* and the individual liquid chambers 9*b* and 9*c*.

Further, liquid is not filled in the first and second non-ejection grooves 4*a* and 4*b*. Further, wiring between the first and second individual terminals 17*a* and 17*b* and the drive electrodes 13 of the first and second non-ejection grooves 4*a* and 4*b* does not have contact with liquid. Therefore, even when conductive liquid is used, a drive signal applied between the first individual terminals 17*a* or the second individual terminals 17*b* and the first common terminals 16*a* or the second common terminals 16*b* does not leak through the liquid. Further, a trouble caused by the electrolysis of the drive electrodes 13 or the wiring does not occur.

Since the piezoelectric substrate 2 is configured in the above manner, it is possible to reduce the distance between the first groove row 5*a* and the second groove row 5*b*. Therefore, the first and second ejection grooves 3*a* and 3*b* can be arranged in high density. In addition, it is possible to increase the number of piezoelectric substrates 2 obtained from a single piezoelectric wafer to thereby achieve cost reduction. As already described in the first embodiment, when the thickness t1 of the piezoelectric substrate 2 is 360 μm, the length w1 in the groove direction of the inclined surface 6 of each of the ejection grooves 3 is approximately 3.5 mm. Further, the ejection grooves 3 and the non-ejection groove 4 do not communicate with each other in the thickness direction T, and the length w2 in the groove direction of the overlapping portion is approximately 2 mm. When the thickness t1 is 300 μm, the length w1 in the groove direction of the inclined surface 6 is approximately 3.1 mm, and, on the other hand, the length w2 in the groove direction of the overlapping portion is approximately 1.7 mm. When considering placing the liquid chamber 9 on the cover plate 8 and placing the common terminals 16 and the individual terminals 17 on the piezoelectric substrate 2, the width of the piezoelectric substrate 2 is reduced compared to the length of the overlapping portion, and the number of piezoelectric substrates 2 obtained from a single piezoelectric wafer can be increased.

Further, the second ends of the first ejection grooves 3*a* and the first ends of the second ejection grooves 3*b* overlap each other in the reference direction K, and the first non-ejection grooves 4*a* and the second non-ejection grooves 4*b* are not open in this overlapping area. Further, the first and second non-ejection grooves 4*a* and 4*b* are not open also in an area of the first ends of the first ejection grooves 3*a* and an area of the second ends of the second ejection grooves 3*b*. Therefore, it is not necessary to provide slits for blocking the first non-ejection grooves 4*a* and the second non-ejection grooves 4*b*. As a result, the structure of the cover plate 8 can be extremely simplified.

For example, when a nozzle pitch of the first nozzle array 12*a* or the second nozzle array 12*b* arrayed in the reference direction K is 100 μm, a pitch in the reference direction K of the first non-ejection grooves 4*a* or the second non-ejection grooves 4*b* is also 100 μm. When ejection grooves and non-ejection grooves are open on the upper surface US of the piezoelectric substrate 2, which is different from the present invention, slits to be formed on the liquid chamber of the cover plate 8 are required to be formed at a pitch of 100 μm in the reference direction K. Further, it is necessary to use a material having the same level of thermal expansion coefficient as the piezoelectric substrate 2 in the cover plate 8. A ceramic material on which fine processing is difficult to be performed, for example, PZT ceramics which is the same as the material of the piezoelectric substrate 2 is used. A high processing technique is required to provide slits at a pitch of 100 μm on this ceramic material. There is a tendency of narrowing a nozzle pitch. Therefore, the cover plate that does not require fine slits as in the present embodiment can largely contribute to cost reduction of the liquid jet head 1.

Third Embodiment

Figure 6A:
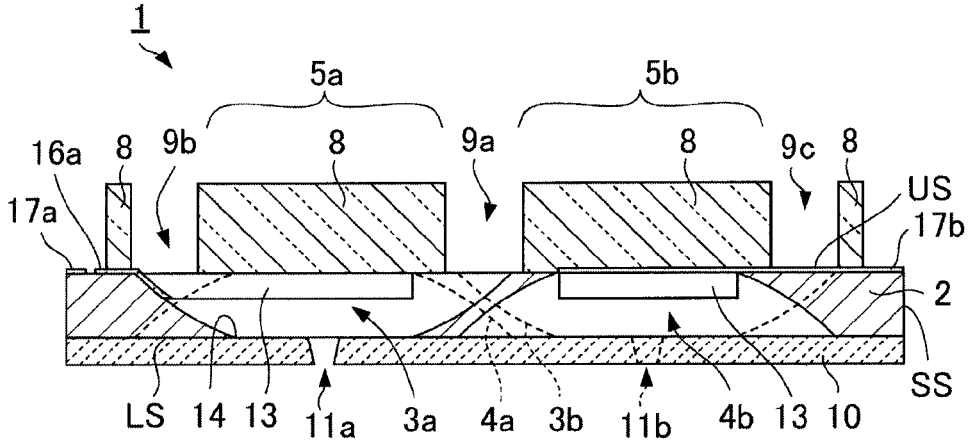
FIGS. 6A and 6B are explanatory drawings of a liquid jet head according to a third embodiment of the present invention.
Figure 6B:
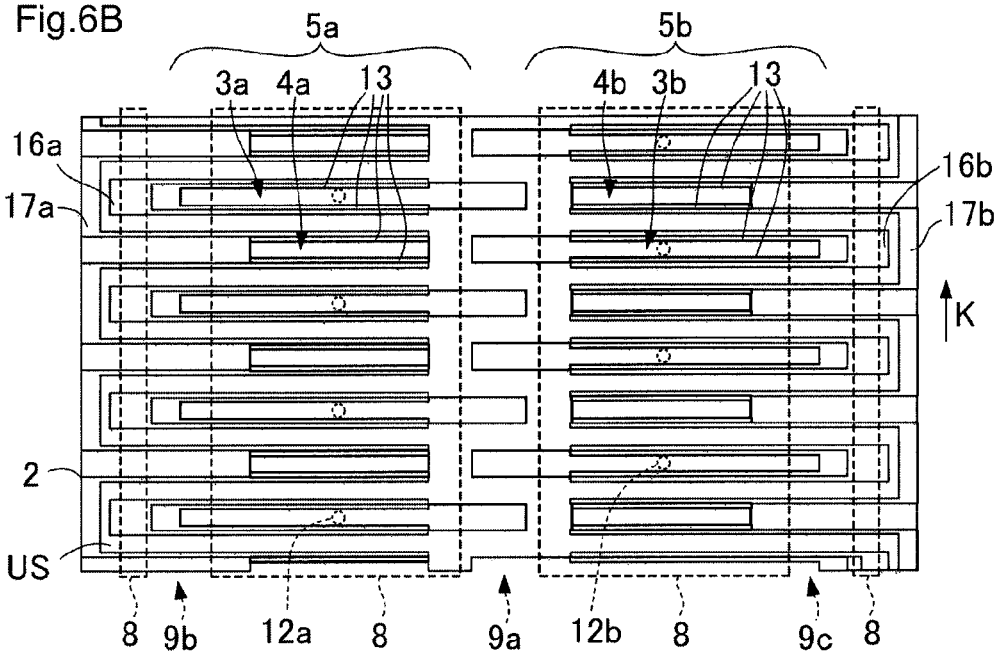

FIGS. 6A and 6B are explanatory drawings of a liquid jet head 1 according to the third embodiment of the present invention. FIG. 6A is a schematic vertical cross-sectional view of the liquid jet head 1 in the groove direction. FIG. 6B is a schematic plan view of a piezoelectric substrate 2 viewed from an upper surface US thereof. Different points from the second embodiment are placement positions of drive electrodes 13, common terminals 16, and individual terminals 17, and the shape of a part of each non-ejection groove 4. The other configurations are substantially the same as those of the second embodiment. Therefore, hereinbelow, the different points from the second embodiment will be mainly described, and description of the same points will be omitted. The same components or components having the same function are denoted by the same marks throughout the drawings.

As illustrated in FIG. 6A, the liquid jet head 1 is provided with the piezoelectric substrate 2, a cover plate 8 which is bonded to the upper surface US of the piezoelectric substrate 2, and a nozzle plate 10 which is bonded to a lower surface LS of the piezoelectric substrate 2. The width in the groove direction of the piezoelectric substrate 2 is wider than the width in the groove direction of the cover plate 8. The cover plate 8 is bonded to the upper surface US of the piezoelectric substrate 2 so that a part of the upper surface US, the part being located near opposite ends in the groove direction of the piezoelectric substrate 2, is exposed.

As with the second embodiment, a first groove row 5*a* has elongated first ejection grooves 3*a* and elongated first non-ejection grooves 4*a* which are alternately arranged in a reference direction K, a second groove row 5*b* has elongated second ejection grooves 3*b* and elongated second non-ejection grooves 4*b* which are alternately arranged in the reference direction K, and the first groove row 5*a* and the second groove row 5*b* are arranged in parallel to each other in the reference direction K. Further, as with the second embodiment, second ends of the first ejection grooves 3*a* included in the first groove row 5*a* located on the first side and first ends of the second non-ejection grooves 4*b* included in the second groove row 5*b* located on the second side are separated from each other, and overlap each other in the thickness direction of the piezoelectric substrate 2. Further, first ends of the second ejection grooves 3*b* included in the second groove row 5*b* located on the second side and second ends of the first non-ejection grooves 4*a* included in the first groove row 5*a* located on the first side are separated from each other, and overlap each other in the thickness direction of the piezoelectric substrate 2. Further, as with the second embodiment, the second ends of the first ejection grooves 3*a* included in the first groove row 5*a* located on the first side and the first ends of the second ejection grooves 3*b* included in the second groove row 5*b* located on the second side overlap each other in the reference direction K.

The cross-sectional shape of the first and second non-ejection grooves 4*a* and 4*b* substantially conforms with a vertically inverted shape of the cross-sectional shape of the first and second ejection grooves 3*a* and 3*b*. That is, ends of the first and second non-ejection grooves 4*a* and 4*b*, the ends being located opposite to the adjacent side, do not extend up to a side surface SS of the piezoelectric substrate 2, which is different from the second embodiment.

Drive electrodes 13 are formed on side surfaces of the first and second ejection grooves 3*a* and 3*b* and the first and second non-ejection grooves 4*a* and 4*b* not in a part between a position corresponding to approximately ½ of the thickness of the piezoelectric substrate 2 and the lower surface LS, but in a part between the position corresponding to approximately ½ of the thickness of the piezoelectric substrate 2 and the upper surface US. Further, the positions in the groove direction of drive electrodes 13 that are formed on the side surfaces of each of the first non-ejection grooves 4*a* or the second non-ejection grooves 4*b* are within an area of an opening portion 14 in which each of the first non-ejection grooves 4*a* or the second non-ejection grooves 4*b* is open on the upper surface US of the piezoelectric substrate 2. When a chevron type substrate is used as the piezoelectric substrate 2, the drive electrodes 13 can be formed on the side surfaces of the first and second ejection grooves 3*a* and 3*b* and the first and second non-ejection grooves 4*a* and 4*b* up to a position deeper than ½ of the thickness of the piezoelectric substrate 2.

As illustrated in FIG. 6B, on the upper surface US of the piezoelectric substrate 2, there are placed first common terminals 16*a* which are electrically connected to drive electrodes 13 formed on the side surfaces of the first ejection grooves 3*a* and first individual terminals 17*a* which are electrically connected to drive electrodes 13 of the first non-ejection grooves 4*a*. Further, on the upper surface US of the piezoelectric substrate 2, there are placed second common terminals 16*b* which are electrically connected to drive electrodes 13 of the second ejection grooves 3*b* and second individual terminals 17*b* which are electrically connected to drive electrodes 13 of the second non-ejection grooves 4*b*. The first common terminals 16*a* and the first individual terminals 17*a* are provided so as to extend up to the vicinity of an end on the first side of the upper surface US of the piezoelectric substrate 2. The second common terminals 16*b* and the second individual terminals 17*b* are provided so as to extend up to the vicinity of an end on the second side of the upper surface US. These first and second common terminals 16*a* and 16*b* and the first and second individual terminals 17*a* and 17*b* are connected to wiring formed on a flexible circuit board, so that a drive signal can be supplied to each of the drive electrodes 13.

More specifically, in the first grooves row 5*a*, drive electrodes 13 formed on both side surfaces of each of the first ejection grooves 3*a* are connected to the corresponding first common terminals 16*a*. Further, drive electrodes 13 formed on side surfaces of two first non-ejection grooves 4*a* between which a first ejection groove 3*a* is interposed, the side surfaces facing the first ejection groove 3*a*, are electrically connected to each other through the corresponding first individual terminal 17*a*. The first individual terminals 17*a* are placed on the upper surface US at the end facing the first groove row 5*a* of the piezoelectric substrate 2. The first common terminals 16*a* are placed on the upper surface US at positions between the first individual terminals 17*a* and the first ejection grooves 3*a*. Also in the second groove row 5*b*, the second common terminals 16*b* and the second individual terminals 17*b* are connected and placed in the same manner as the first common terminals 16*a* and the first individual terminals 17*a*.

In the present embodiment, the first and second common terminals 16*a* and 16*b* and the first and second individual terminals 17*a* and 17*b* are placed on the upper surface US of the piezoelectric substrate 2. However, the present invention is not limited to this configuration. The first and second common terminals 16*a* and 16*b* and the first and second individual terminals 17*a* and 17*b* may be formed on a surface of the cover plate 8, the surface being opposite to the piezoelectric substrate 2, and through electrodes may be formed on the cover plate 8 to thereby electrically connect the first and second common terminals 16*a* and 16*b* and the first and second individual terminals 17*a* and 17*b* to the drive electrodes 13 formed on the side surfaces of the first and second ejection grooves 3*a* and 3*b* and the drive electrodes 13 formed on the side surfaces of the first and second non-ejection grooves 4*a* and 4*b*. Accordingly, it is possible to prevent liquid from making contact with electrodes of the first common terminal 16*a* or the second common terminal 16*b* and the first individual terminal 17*a* or the second individual terminal 17*b*.

The liquid jet head 1 having the two groove rows, namely, the first groove row 5*a* and the second groove row 5*b* has been described above in the first to third embodiments. However, the present invention is not limited to the two groove rows, and may have three or more groove rows. In this case, a configuration in which the configuration of the first to third embodiments is included at least in adjacent two groove rows falls within the scope of the invention. For example, even when, in the second groove row and the third groove row, ejection grooves included in the second groove row and non-ejection grooves included in the third groove row do not overlap each other in the thickness direction of a piezoelectric substrate, and non-ejection grooves included in the second groove row and ejection grooves included in the third groove row do not overlap each other, if the first groove row and the second groove row satisfy the configuration of the first to third embodiments, such configuration falls within the scope of the invention.

Fourth Embodiment

Figure 7:
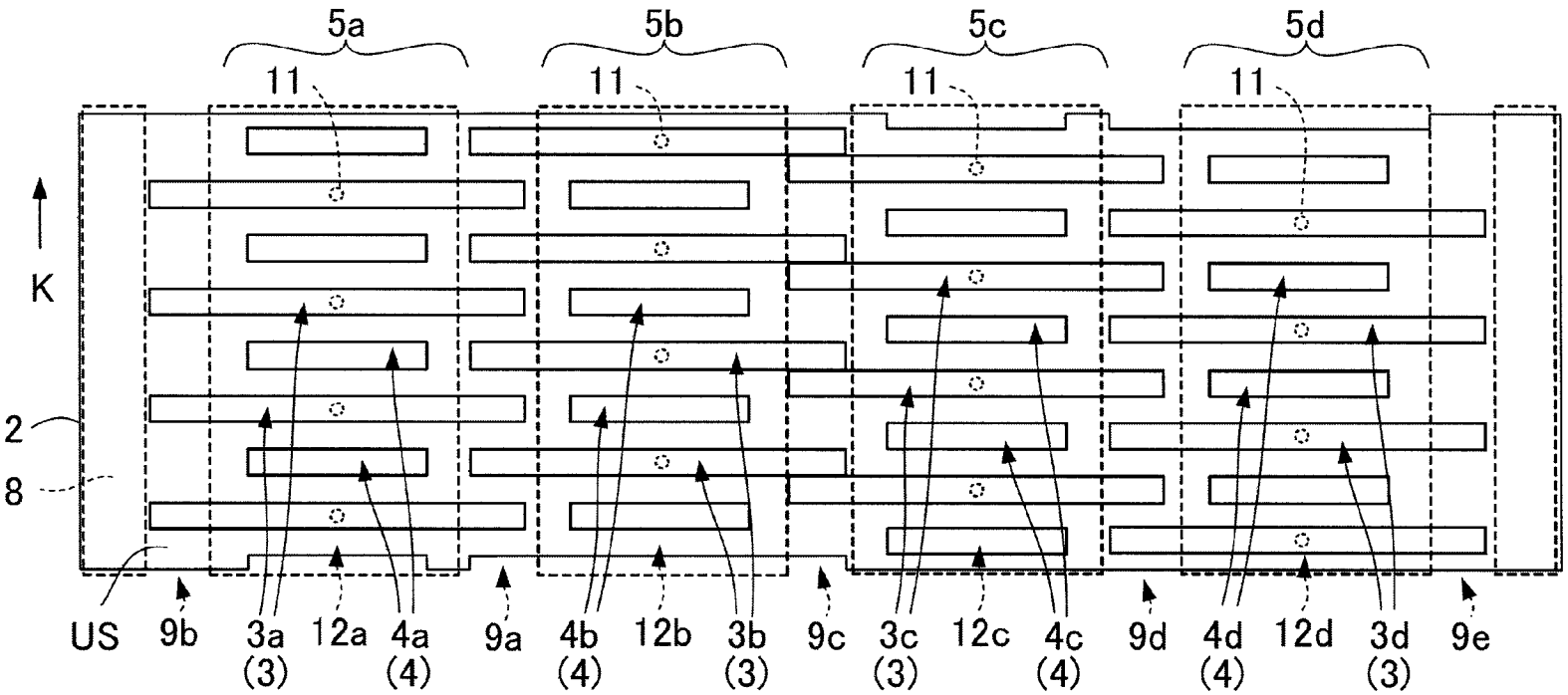
FIG. 7 is a partial schematic top view of a piezoelectric substrate of a liquid jet head according to a fourth embodiment of the present invention.

FIG. 7 is a partial schematic top view of a piezoelectric substrate 2 of a liquid jet head 1 according to the fourth embodiment of the present invention. A different point from the second embodiment or the third embodiment is that four groove rows are arranged in a reference direction K side by side. The same components or components having the same function are denoted by the same marks throughout the drawings.

As illustrated in FIG. 7, the piezoelectric substrate 2 has four groove rows, specifically, first to fourth groove rows 5*a* to 5*d* in each of which elongated ejection grooves 3 and elongated non-ejection grooves 4 are alternately arranged in the reference direction K. The arrangement of ejection grooves 3 and non-ejection grooves 4 of the second groove row 5*b* is deviated by a ½ pitch in the reference direction K from that of the first groove row 5*a*. The arrangement of ejection grooves 3 and the non-ejection grooves 4 of the third groove row 5*c* is deviated by a −¼ pitch in the reference direction K from that of the second groove row 5*b*. The arrangement of ejection groove 3 and the non-ejection grooves 4 of the fourth groove row 5*d* is deviated by a −½ pitch in the reference direction K from that of the third groove row 5*c*. When viewed from the groove direction, the ejection grooves 3 are arranged at equal intervals of ¼ pitch, which results in a quadruple recording density in the reference direction K.

Both ends of each of the ejection grooves 3*a* to 3*d* have inclined surfaces which are inclined outward from the lower surface LS toward the upper surface US of the piezoelectric substrate 2. Further, both ends of each of the non-ejection grooves 4*a* to 4*d* have inclined surfaces which are inclined outward from the upper surface US toward the lower surface LS of the piezoelectric substrate 2. Further, the first ejection grooves 3*a* (first non-ejection grooves 4*a*) of the first groove row 5*a* and the second non-ejection grooves 4*b* (second ejection grooves 3*b*) of the second grove row 5*b* are separated from each other, and overlap each other in the thickness direction of the piezoelectric substrate 2. More specifically, in the first groove row 5*a* and the second groove row 5*b* which are adjacent to each other, ends facing the second groove row 5*b* of the first ejection grooves 3*a* included in the first groove row 5*a* located on the first side and ends facing the first groove row 5*a* of the second non-ejection grooves 4*b* included in the second groove row 5*b* located on the second side are separated from each other, and overlap each other in the thickness direction of the piezoelectric substrate 2. Similarly, ends facing the first groove row 5*a* of the second ejection grooves 3*b* included in the second groove row 5*b* located on the second side and ends facing the second groove row 5*b* of the first non-ejection grooves 4*a* included in the first groove row 5*a* located on the first side are separated from each other, and overlap each other in the thickness direction of the piezoelectric substrate 2. Accordingly, it is possible to reduce the distance between the first groove row 5*a* and the second groove row 5*b*.

Further, the third ejection grooves 3*c* (third non-ejection grooves 4*c*) of the third groove row 5*c* and the fourth non-ejection grooves 4*c* (fourth ejection grooves 3*d*) of the fourth groove row 5*d* are separated from each other, and overlap each other in the thickness direction of the piezoelectric substrate 2. More specifically, in the third groove row 5*c* and the fourth groove row 5*d* which are adjacent to each other, ends facing the fourth groove row 5*d* of the third ejection grooves 3*c* included in the third groove row 5*c* located on the first side and ends facing the third groove row 5*c* of the fourth non-ejection grooves 4*d* included in the fourth groove row 5*d* located on the second side are separated from each other, and overlap each other in the thickness direction of the piezoelectric substrate 2. Similarly, ends facing the third groove row 5*c* of the fourth ejection grooves 3*d* included in the fourth groove row 5*d* located on the second side and ends facing the fourth groove row 5*d* of the third non-ejection grooves 4*c* included in the third groove row 5*c* located on the first side are separated from each other, and overlap each other in the thickness direction of the piezoelectric substrate 2. Accordingly, it is possible to reduce the distance between the third groove row 5*c* and the fourth groove row 5*d*.

Further, in the second groove row 5*b* and the third groove row 5*c* which are adjacent to each other, ends facing the third groove row 5*c* of the second ejection grooves 3*b* included in the second groove row 5*b* located on the first side and ends facing the second groove row 5*b* of the third ejection grooves 3*c* included in the third groove row 5*c* located on the second side overlap each other or communicate with each other in the reference direction K. Similarly, in the second groove row 5*b* and the third groove row 5*c* which are adjacent to each other, ends facing the third groove row 5*c* of the second non-ejection grooves 4*b* included in the second groove row 5*b* located on the first side and ends facing the second groove row 5*b* of the third non-ejection grooves 4*c* included in the third groove row 5*c* located on the second side overlap each other or communicate with each other in the reference direction K. Accordingly, it is possible to reduce the distance between the second groove row 5*b* and the third groove row 5*c*.

A cover plate 8 is bonded to the upper surface US of the piezoelectric substrate 2. Common liquid chambers 9*a* and 9*d* and individual liquid chambers 9*b*, 9*c*, 9*e* which are separated from each other are placed on the cover plate 8. The common liquid chamber 9*a* communicates with the ends facing the second groove row 5*b* of the first ejection grooves 3*a* of the first groove row 5*a* and the ends facing the first groove row 5*a* of the second ejection grooves 3*b* of the second groove row 5*b*. The common liquid chamber 9*d* communicates with the ends facing the fourth groove row 5*d* of the third ejection grooves 3*c* of the third groove row 5*c* and the ends facing the third groove row 5*c* of the fourth ejection grooves 3*d* of the fourth groove row 5*d*. The individual liquid chamber 9*b* communicates with ends opposite to the second groove row 5*b* of the first ejection grooves 3*a* of the first groove row 5*a*. The individual liquid chamber 9*e* communicates with ends opposite to the third groove row 5*c* of the fourth ejection grooves 3*d* of the fourth groove row 5*d*. Further, the individual liquid chamber 9*c* communicates with the ends facing the third groove row 5*c* of the second ejection grooves 3*b* of the second groove row 5*b* and the ends facing the second groove row 5*b* of the third ejection grooves 3*c* of the third groove row 5*c*. In this manner, each of the common liquid chambers 9*a* and 9*d* and the individual liquid chamber 9*c* commonly communicates with ejection grooves of adjacent groove rows, and the non-ejection grooves 4 are not open in an area in which each of the liquid chambers is open. Therefore, the structure of the cover plate 8 can be simplified. Further, the length in the groove direction of each of the piezoelectric substrate 2 and the cover plate 8 can be largely shortened.

A nozzle plate 10 (not illustrated) is bonded to the lower surface LS (not illustrated) of the piezoelectric substrate 2. The nozzle plate 10 is provided with nozzles 11 which communicate with the respective ejection grooves 3*a* to 3*d*. The nozzles 11 form first to fourth nozzle arrays 12*a* to 12*d* which respectively correspond to the first to fourth groove rows 5*a* to 5*d*. Drive electrodes are formed on side surfaces of each of the grooves. Each of the drive electrodes can be electrically connected to an external circuit through a common terminal or an individual terminal placed on the lower surface LS or the upper surface US of the piezoelectric substrate 2. When the common terminal and the individual terminal are extracted to the upper surface US of the piezoelectric substrate 2, for example, through electrodes are provided on the cover plate 8, and the common terminal and the individual terminal can be extracted to the surface of the cover plate 8 through the through electrodes.

In the present embodiment, in order to reduce the distance between the second groove row 5*b* and the third groove row 5*c*, the second ejection grooves 3*b* and the third ejection grooves 3*c* are allowed to communicate with an opening portion of the individual liquid chamber 9*c*. However, alternatively, the second groove row 5*b* and the third groove row 5*c* may be separated from each other, and a terminal region of the common terminal and the individual terminal may be placed between the second groove row 5*b* and the third groove row 5*c*. Further, since the materials of the piezoelectric substrate 2 and the cover plate 8 are the same as those of the first to third embodiment, description thereof will be omitted.

Fifth Embodiment

Figure 8:
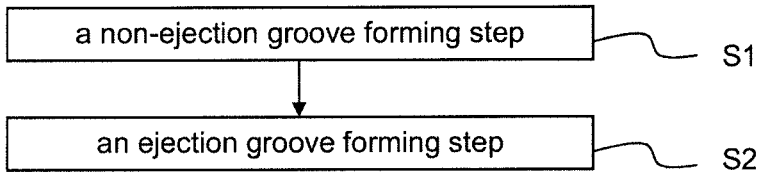
FIG. 8 is a flow chart illustrating a method of manufacturing a liquid jet head according to a fifth embodiment of the present invention.
Figure 9:
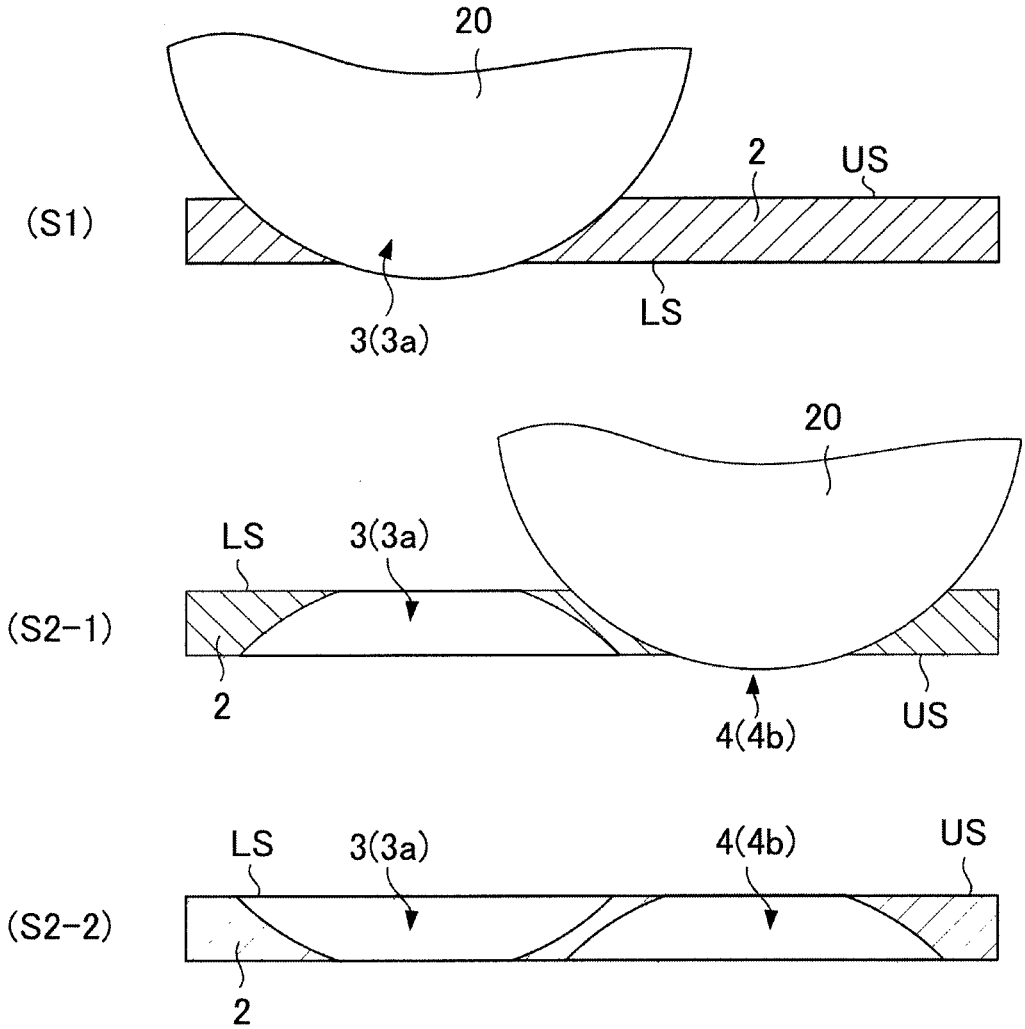
FIG. 9 is a diagram for explaining the method of manufacturing the liquid jet head according to the fifth embodiment of the present invention.

FIG. 8 is a flow chart illustrating a method of manufacturing a liquid jet head 1 according to the fifth embodiment of the present invention. FIG. 9 is a diagram for explaining the method of manufacturing the liquid jet head 1 according to the fifth embodiment. FIG. 9 (S1) illustrates a state where an ejection groove 3 is formed on a piezoelectric substrate 2 using a dicing blade 20. FIG. 9 (S2-1) illustrates a state where a non-ejection groove 4 is formed on the piezoelectric substrate 2 using the dicing blade 20. FIG. 9 (S2-2) is a schematic cross-sectional view of the piezoelectric substrate 2 on which the ejection groove 3 and the non-ejection groove 4 are formed. The present embodiment is a basic configuration of the method of manufacturing the liquid jet head 1 according to the present invention. The same components or components having the same function are denoted by the same marks throughout the drawings.

As illustrate in FIG. 8, the method of manufacturing the liquid jet head 1 includes an ejection groove forming step S1 and a non-ejection groove forming step S2. The order of the steps may be such that the non-ejection groove forming step S2 is first performed, and the ejection groove forming step S1 is thereafter performed. As illustrated in FIG. 9 (S1), in the ejection groove forming step S1, the piezoelectric substrate 2 is cut from an upper surface US thereof using the disk-like dicing blade 20 to form a plurality of elongated ejection grooves 3. Then, as illustrated in FIG. 9 (S2-1), in the non-ejection groove forming step S2, the piezoelectric substrate 2 is cut from a lower surface LS thereof located opposite to the upper surface US using the disk-like dicing blade 20 to form a plurality of elongated non-ejection grooves 4 in parallel to the groove direction of the ejection grooves 3.

At this point, a first groove row 5*a* in which first ejection grooves 3*a* and first non-ejection grooves 4*a* are alternately arranged in the reference direction K and a second groove row 5*b* in which second ejection grooves 3*b* and second non-ejection grooves 4*b* are alternately arranged in the reference direction K are formed (see FIG. 1). Further, as illustrated in FIG. 9 (S2-2), the grooves are formed so that, in the adjacent first and second groove rows 5*a* and 5*b*, second ends of the first ejection grooves 3*a* included in the first groove row 5*a* located on the first side and first ends of the second non-ejection grooves 4*b* included in the second groove row 5*b* located on the second side are separated from each other, and overlap each other in the thickness direction of the piezoelectric substrate 2. Similarly, the grooves are formed so that first ends of the second ejection grooves 3*b* included in the second groove row 5*b* located on the second side and second ends of the first non-ejection grooves 4*a* included in the first groove row 5*a* located on the first side are separated from each other, and overlap each other in the thickness direction of the piezoelectric substrate 2. Accordingly, the distance between the first groove row 5*a* and the second groove row 5*b* which are adjacent to each other can be reduced. Therefore, the number of piezoelectric substrates 2 obtained from a single piezoelectric wafer is increased, thereby making it possible to achieve cost reduction.

Further, the grooves can be formed so that, in the adjacent first and second groove row 5*a* and 5*b*, the second ends of the first ejection grooves 3*a* included in the first groove row 5*a* located on the first side and the first ends of the second ejection grooves 3*b* included in the second groove row 5*b* located on the second side overlap each other in the reference direction K. Similarly, the grooves can be formed so that the second ends of the first non-ejection grooves 4*a* included in the first groove row 5*a* located on the first side and the first ends of the second non-ejection grooves 4*b* included in the second groove row 5*b* located on the second side overlap each other in the reference direction K. Further, the grooves can be formed so that, in an area in which the first ejection grooves 3*a* and the second ejection grooves 3*b* overlap each other in the reference direction K, all of the first ejection grooves 3*a* of the first groove row 5*a* and the second ejection grooves 3*b* of the second groove row 5*b* are open on the upper surface US and all of the first non-ejection grooves 4*a* of the first groove row 5*a* and the second non-ejection grooves 4*b* of the second groove row 5*b* are not open on the upper surface US.

Accordingly, the structure of a liquid chamber 9 of a cover plate 8 which is bonded to the upper surface US of the piezoelectric substrate 2 can be simplified. That is, it is not necessary to provide slits for preventing communication with the first and second non-ejection grooves 4*a* and 4*b* on a common liquid chamber 9*a* of the cover plate 8, the common liquid chamber 9*a* communicating with the first and second ejection grooves 3*a* and 3*b*.

Hereinbelow, detailed description will be made. PZT ceramics can be used as the piezoelectric substrate 2. As the dicing blade 20, one having abrasive grains such as diamond embedded on the periphery thereof can be used. In the first groove row 5*a* or the second groove row 5*b*, a pitch of the ejection grooves 3 may be several tens of μm to several hundred of μm. Although it is an essential requirement that the first and second ejection grooves 3*a* and 3*b* penetrate the piezoelectric substrate 2 in the thickness direction thereof, the first and second non-ejection grooves 4*a* and 4*b* may penetrate or may not penetrate the piezoelectric substrate 2 in the thickness direction thereof. However, a drive wall between a first ejection groove 3*a* and a first non-ejection groove 4*a* preferably has the same shape on both of the side facing the first ejection groove 3*a* and the side facing the first non-ejection groove 4*a*. The shape of a drive wall between a second ejection groove 3*b* and a second non-ejection groove 4*b* is the same as above.

Further, it is not an essential requirement that, in the ejection groove forming step S1 or the non-ejection groove forming step S2, the piezoelectric substrate 2 is cut deeper than the thickness thereof to thereby allow the first ejection groove 3*a* or the second ejection groove 3*b* to penetrate the piezoelectric substrate 2. For example, the piezoelectric substrate 2 may be cut up to an intermediate position in the thickness direction thereof in the ejection groove forming step S1 or the non-ejection groove forming step S2, and the upper surface US or the lower surface LS may be thereafter ground to thereby allow at least the first and second ejection grooves 3*a* and 3*b* to penetrate the piezoelectric substrate 2.

The thickness of the piezoelectric substrate 2 can be, for example, 200 μm to 400 μm. The closest distance between the first ejection grooves 3*a* and the second non-ejection grooves 4*b* is preferably 10 μm or more. For example, in a case where the shape of the first and second ejection grooves 3*a* and 3*b* and the shape of the first and second non-ejection grooves 4*a* and 4*b* are vertically inverted and substantially the same shape, when the thickness of the piezoelectric substrate 2, that is, the depth of the first and second ejection grooves 3*a* and 3*b* and the first and second non-ejection grooves 4*a* and 4*b* is formed to be 360 μm, the length w1 in the groove direction of the inclined surface 6 of the ejection groove 3 is approximately 3.5 mm. Further, the ejection grooves 3 and the non-ejection grooves 4 do not communicate with each other in the thickness direction T, and the length w2 of the overlapping portion in the groove direction is approximately 2 mm. When the thickness of the piezoelectric substrate 2 is 300 μm, the length w1 of the inclined surface 6 is approximately 3.1 mm, and, on the other hand, the length w2 of the overlapping portion in the groove direction is approximately 1.7 mm. When the thickness of the piezoelectric substrate 2 is 250 μm, the length w1 of the inclined surface 6 is approximately 2.8 mm, and, on the other hand, the length w2 of the overlapping portion in the groove direction is approximately 1.4 mm. In this manner, it is possible to reduce the distance between the groove rows, and thereby arrange the ejection grooves in high density.

Further, the present invention is not limited to the example in which the two rows, namely, the first groove row 5*a* and the second groove row 5*b* are formed. Multiple rows including three or more groove rows may be formed. Also in this case, as described in the third and fourth embodiments, it is only required that, in any adjacent ones of the groove rows, ends on the second side of ejection grooves included in a groove row located on the first side and ends on the first side of non-ejection grooves included in a groove row located on the second side are separated from each other, and overlap each other in the thickness direction of the piezoelectric substrate 2, and it is not necessary to satisfy the above requirement in all adjacent groove rows.

Sixth Embodiment

Figure 10:
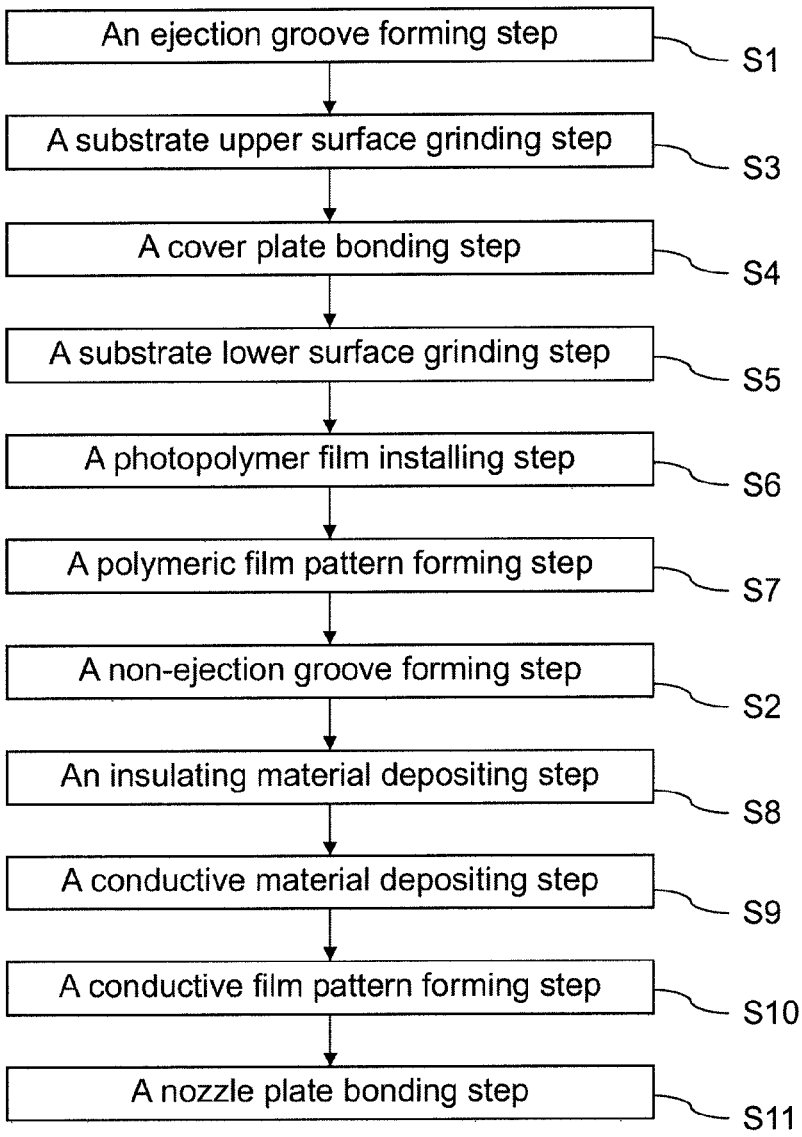
FIG. 10 is a flow chart of a method of manufacturing a liquid jet head according to a sixth embodiment of the present invention.

FIGS. 10 to 16 are explanatory drawings of a method of manufacturing a liquid jet head 1 according to the sixth embodiment of the present invention. FIG. 10 is a flow chart of the method of manufacturing the liquid jet head 1. Each of FIGS. 11 to 16 is a schematic cross-sectional view or a schematic plan view for explaining each step. The same components or components having the same function are denoted by the same marks throughout the drawings.

As illustrated in FIG. 10, the method of manufacturing the liquid jet head 1 according to the present embodiment includes: an ejection groove forming step S1 for forming elongated ejection grooves 3 on an upper surface US of a piezoelectric substrate 2; a substrate upper surface grinding step S3 for grinding the upper surface US of the piezoelectric substrate 2 to thin the thickness of the piezoelectric substrate 2; a cover plate bonding step S4 for bonding a cover plate 8 to the ground upper surface US; a substrate lower surface grinding step S5 for grinding a lower surface LS of the piezoelectric substrate 2 to allow the ejection grooves 3 to be open on the lower surface LS; a photosensitive resin film placing step S6 for placing a photosensitive resin film 21 on the ground lower surface LS; a resin film pattern forming step S7 for patterning the photosensitive resin film 21; a non-ejection groove forming step S2 for forming elongated non-ejection grooves 4 on the lower surface LS on which a pattern of the photosensitive resin film 21 is formed at positions between the ejection grooves 3 arranged in the reference direction K; an insulating material depositing step S8 for depositing an insulating material from the lower surface LS of the piezoelectric material 2; a conductive material depositing step S9 for depositing a conductive material from the lower surface LS of the piezoelectric substrate 2; a conductive film pattern forming step S10 for patterning the conductive film by a lift-off method; and a nozzle plate bonding step S11 for bonding a nozzle plate 10 to the lower surface LS of the piezoelectric substrate 2.

Hereinbelow, each of the steps will be described with reference to FIGS. 11 to 16. First, in the ejection groove forming step S1 illustrated in FIG. 11 (S1), the piezoelectric substrate 2 having a thickness t of 0.8 mm is cut from the upper surface US using a disk-like dicing blade 20 to form a plurality of elongated first ejection grooves 3*a* at equal intervals in a reference direction K which is a depth direction of the sheet. Further, a plurality of elongated second ejection grooves 3*b* are formed at equal intervals in the reference direction K which is the depth direction of the sheet in adjacent to the first ejection grooves 3*a*. The first ejection grooves 3*a* constitute a first groove row 5*a*, and the second ejection grooves 3*b* constitute a second groove row 5*b*. Ends facing the second groove row 5*b* of the first ejection grooves 3*a* included in the first groove row 5*a* and ends facing the first groove row 5*a* of the second ejection grooves 3*b* included in the second groove row 5*b* overlap each other in the reference direction K (the depth direction of the sheet). For example, the dicing blade 20 may have a radius of approximately one inch. The piezoelectric substrate 2 is cut up to a depth that does not allow the first and second ejection grooves 3*a* and 3*b* to penetrate the piezoelectric substrate 2 through the lower surface LS thereof to ensure the strength of the piezoelectric substrate 2.

Figure 11:
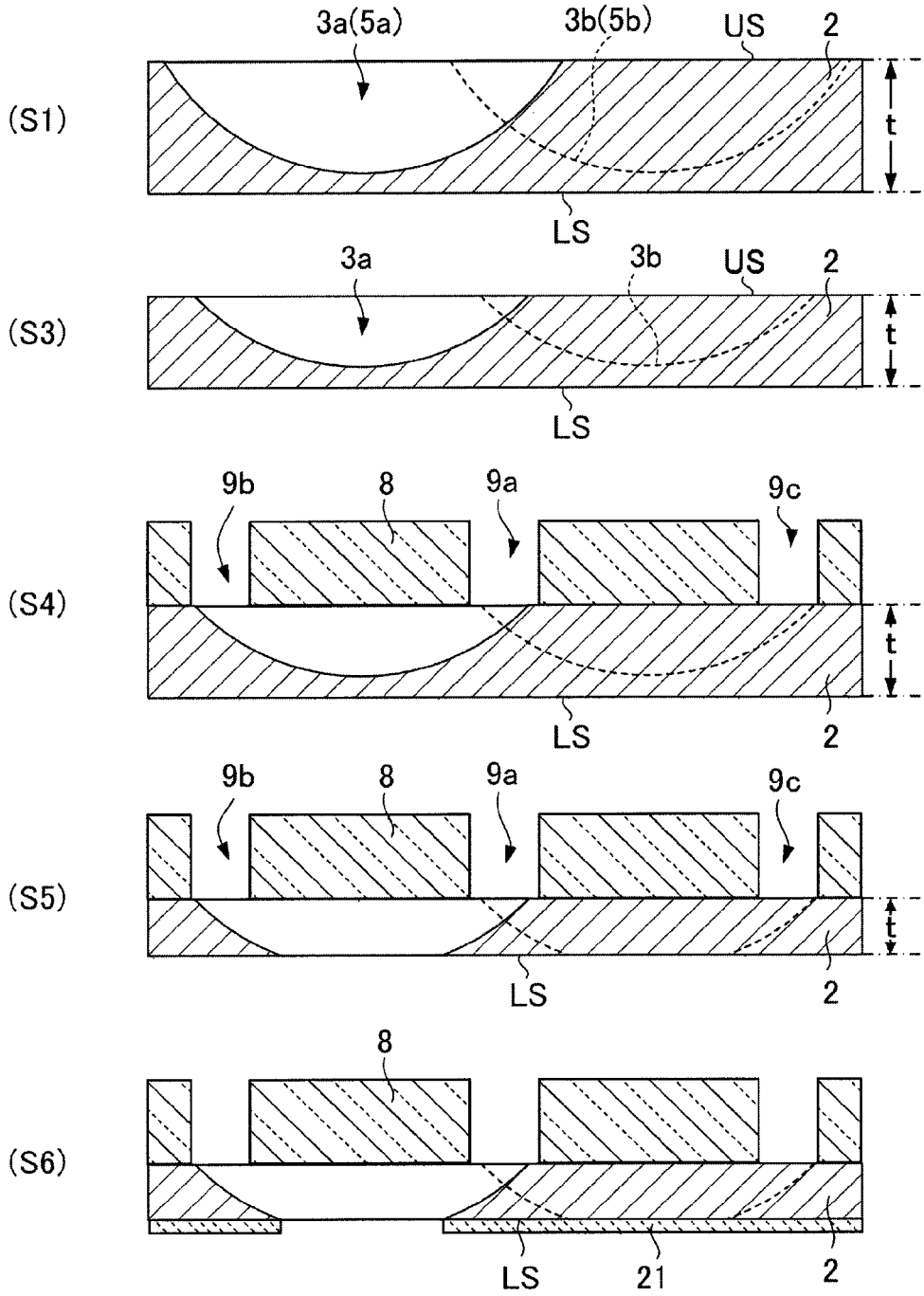
FIG. 11 is a diagram for explaining steps of the method of manufacturing the liquid jet head according to the sixth embodiment of the present invention.
Figure 12:
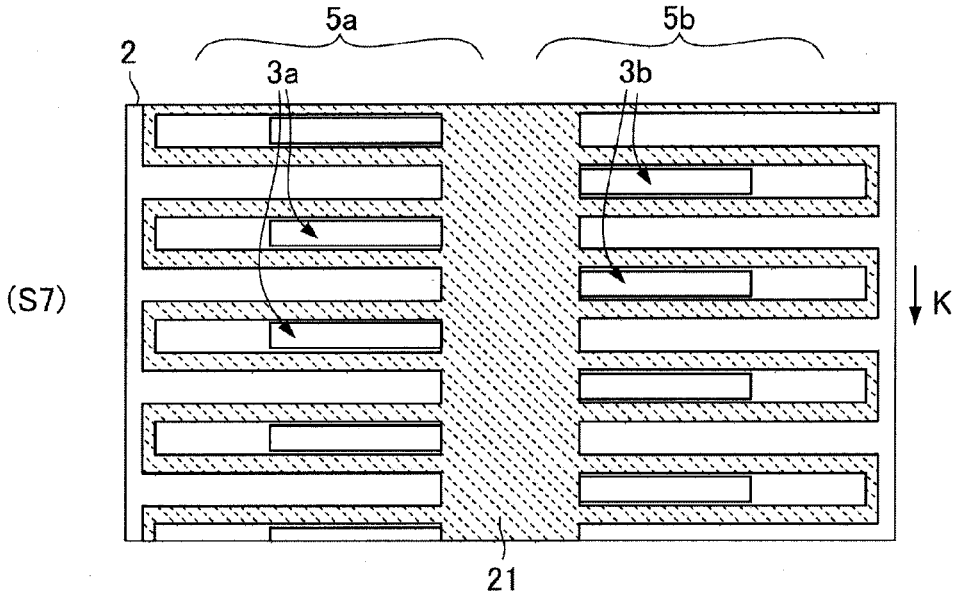
FIG. 12 is a diagram for explaining the steps of the method of manufacturing the liquid jet head according to the sixth embodiment of the present invention.

Then, in the substrate upper surface grinding step S3 illustrated in FIG. 11 (S3), the upper surface US of the piezoelectric substrate 2 is ground to thin the thickness t of the piezoelectric substrate 2 to 0.5 mm. Also at this point, the first and second ejection grooves 3*a* and 3*b* are not open on the lower surface LS of the piezoelectric substrate 2. Therefore, side walls between the ejection grooves 3 are continuous with each other on the lower surface LS of the piezoelectric substrate 2, and the strength of the piezoelectric substrate 2 is therefore maintained. The substrate upper surface grinding step S2 is included in a piezoelectric substrate grinding step. Further, the substrate upper surface grinding step S3 is not an essential requirement of the present invention. When the piezoelectric substrate 2 is cut so as to allow the first ejection grooves 3*a* and the second ejection grooves 3*b* to have a necessary depth in the ejection groove forming step S1, the substrate upper surface grinding step S3 can be omitted.

Then, in the cover plate bonding step S4 illustrated in FIG. 11 (S4), the cover plate 8 having a common liquid chamber 9*a* which is formed on the center thereof and individual liquid chambers 9*a* and 9*c* which are formed on both sides of the common liquid chamber 9*a* is bonded to the upper surface US of the piezoelectric substrate 2 with adhesive so as to allow the common liquid chamber 9*a* to communicate with the first and second ejection grooves 3*a* and 3*b*. The common liquid chamber 9*a* has an elongated opening with no slit inside thereof. The individual liquid chamber 9*b* and the individual liquid chamber 9*c* respectively communicate with the first ejection grooves 3*a* and the second ejection grooves 3*b*. Each of the individual liquid chambers 9*b* and 9*c* has an elongated opening with no slit inside thereof as with the common liquid chamber 9*a*.

The material of the cover plate 8 preferably has a thermal expansion coefficient equal to that of the piezoelectric substrate 2. For example, the same material can be used as the cover plate 8 and as the piezoelectric substrate 2. Further, machinable ceramics having a thermal expansion coefficient similar to that of the piezoelectric substrate 2 can be used. Since it is not necessary to provide slits at a pitch of several tens of μm to several hundred of μm on the cover plate 8, the cover plate 8 can be easily manufactured. The cover plate 8 also functions as a reinforcing plate which reinforces the piezoelectric substrate 2.

Then, in the substrate lower surface grinding step S5 illustrated in FIG. 11 (S5), the lower surface LS of the piezoelectric substrate 2 is ground to thin the thickness of the piezoelectric substrate 2 to 0.3 mm to thereby allow the first and second ejection grooves 3*a* and 3*b* to open on the lower surface LS. Accordingly, the positions of the first and second ejection grooves 3*a* and 3*b* can be easily confirmed from the lower surface LS. The substrate grinding step S5 is included in the piezoelectric substrate grinding step.

Then, in the photosensitive resin film placing step S6 illustrated in FIG. 11 (S6), a photosensitive resin film 21 is placed on the lower surface LS of the piezoelectric substrate 2. Specifically, the sheet-like photosensitive resin film 21 is adhered to the lower surface LS. Then, in the resin film pattern forming step S7 illustrated in FIG. 12 (S7), the photosensitive resin film 21 is exposed and developed to form a pattern of the photosensitive resin film 21 indicated by hatching.

Figure 13:
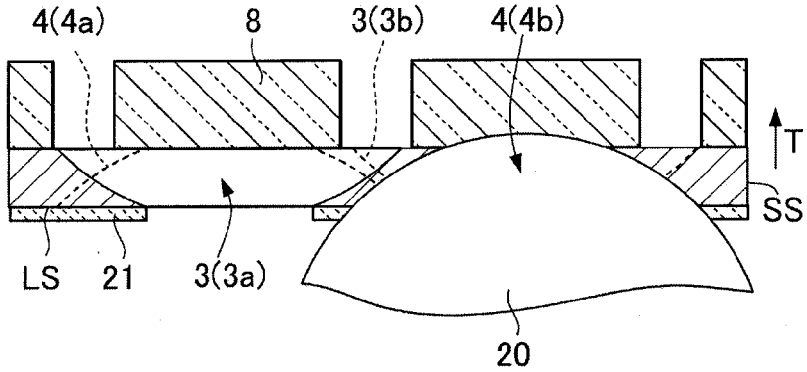
FIG. 13 is a diagram for explaining the steps of the method of manufacturing the liquid jet head according to the sixth embodiment of the present invention.
Figure 13:
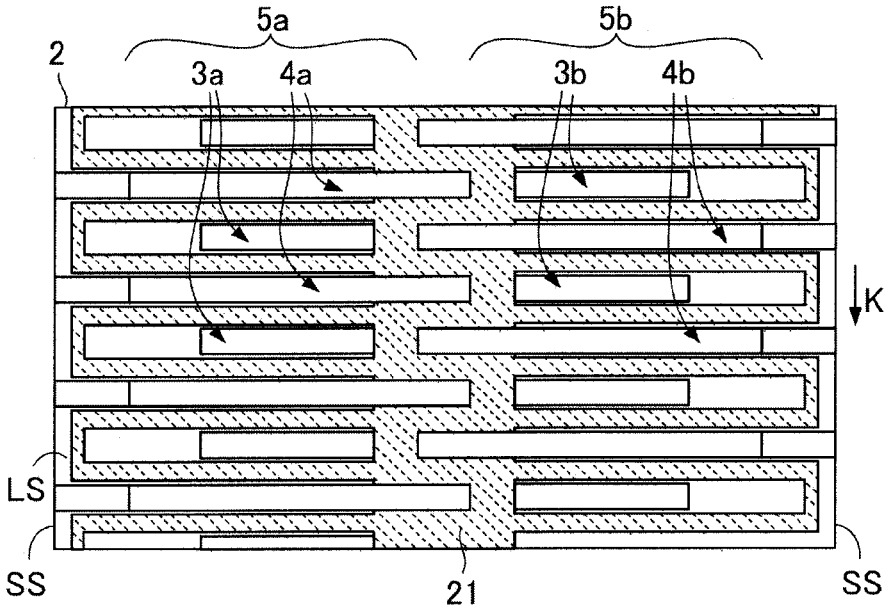

Then, in the non-ejection groove forming step S2 illustrated in FIG. 13 (S2-1), the piezoelectric substrate 2 is cut using the disk-like dicing blade 20 from the lower surface LS located opposite to the upper surface US to form a plurality of elongated non-ejection grooves 4 in parallel to the groove direction of the ejection grooves 3. In the first groove row 5*a*, first non-ejection grooves 4*a* are formed in parallel to and alternate with the first ejection grooves 3*a* in the reference direction K. In the second groove row 5*b*, second non-ejection grooves 4*b* are formed in parallel to and alternate with the second ejection grooves 3*b* in the reference direction K. The cutting is performed up to a depth that slightly reaches the cover plate 8 in order to make a vertically inverted shape of the cross-sectional shape of the non-ejection grooves 4 inside the piezoelectric substrate 2 the same as the cross-sectional shape of the ejection grooves 3.

Further, the grooves are formed so that, in the adjacent first and second groove rows 5*a* and 5*b*, second ends of the first ejection grooves 3*a* included in the first groove row 5*a* located on the first side and first ends of the second non-ejection grooves 4*b* included in the second groove row 5*b* located on the second side are separated from each other, and overlap each other in the thickness direction T of the piezoelectric substrate 2. Similarly, the grooves are formed so that first ends of the second ejection grooves 3*b* included in the second groove row 5*b* located on the second side and second ends of the first non-ejection grooves 4*a* included in the first groove row 5*a* located on the first side are separated from each other, and overlap each other in the thickness direction T of the piezoelectric substrate 2. Further, ends opposite to the first groove row 5*a* of the second non-ejection grooves 4*b* are formed so as to extend up to the side surface SS with leaving a part of the piezoelectric substrate 2, the part having a thickness less than ½ of the thickness of the piezoelectric substrate 2, at the side of the upper surface US. In FIG. 13 (S2-1), the dicing blade 20 is moved down toward the lower surface LS, and moved toward the side surface SS to form the second non-ejection groove 4*b* so as to extend up to the side surface SS. As with the second non-ejection grooves 4*b*, ends opposite to the second groove row 5*b* of the first non-ejection grooves 4*a* are also formed so as to extend up to the side surface SS.

The closest distance between the first ejection grooves 3*a* and the second non-ejection grooves 4*b* and between the second ejection grooves 3*b* and the first non-ejection grooves 4*a* is not less than 10 μm. The overlapping width in the groove direction is approximately 1.7 mm. When the closest distance Δt is less than 10 μm, the first ejection grooves 3*a* and the second non-ejection grooves 4*b* may communicate with each other through a void existing within the piezoelectric substrate 2. Therefore, in order to prevent such a situation, the closest distance Δt is set to 10 μm or more.

FIG. 13 (S2-2) is a schematic plan view of the piezoelectric substrate 2 viewed from the lower surface LS. The first and second ejection grooves 3*a* and 3*b* are open on the lower surface LS. Further, the pattern of the photosensitive resin film 21 is formed on the lower surface LS. Therefore, it is possible to easily perform positioning when cutting the piezoelectric substrate 2 to form the non-ejection grooves 4. Wiring and electrodes of terminals are formed in an area in which the photosensitive resin film 21 is removed and the lower surface LS is thereby exposed.

Figure 14:
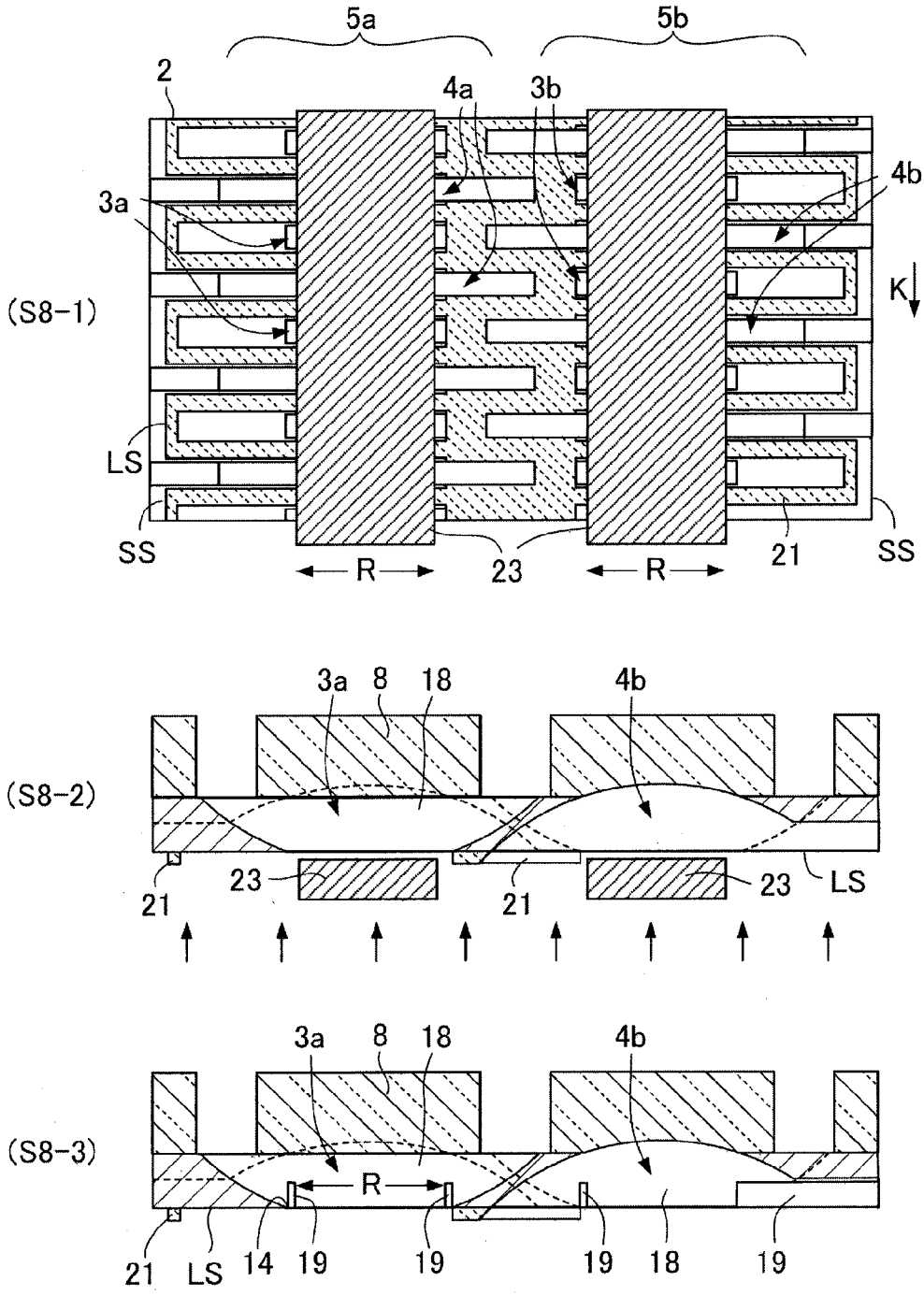
FIG. 14 is a diagram for explaining the steps of the method of manufacturing the liquid jet head according to the sixth embodiment of the present invention.

Then, in the insulating material depositing step S8 illustrated in FIG. 14, an insulating material such as silicone oxide ($SiO_2$, SiO, quartz, silica, etc.) which defines a drive area of side walls 18 is deposited on side surfaces of the first and second ejection grooves 3*a* and 3*b* to form an insulating film 19. FIG. 14 (S8-1) is a schematic plan view illustrating a state where masks 23 are placed on the lower surface LS of the piezoelectric substrate 2 before depositing the insulating material thereon when viewed from the underneath of the lower surface LS. FIG. 14 (S8-2) is a schematic cross-sectional view illustrating a state where the insulating material is deposited on the lower surface LS from the underneath thereof. FIG. 14 (S8-3) is a schematic cross-sectional view illustrating a state where the insulating film 19 is formed on the side surfaces of the first ejection groove 3*a* and the second non-ejection groove 4*b*.

As illustrated in FIG. 14 (S8-1), the masks 23 are placed on the lower surface LS or the vicinity thereof so as to cover ranges R which are located within opening portions 14 in which the first and second ejection grooves 3*a* and 3*b* are open on the lower surface LS and serve as drive areas. Then, as illustrated in FIG. 14 (S8-2), the insulating material indicated by arrows directing from the lower side toward the upper side is deposited by a deposition method. Specifically, the insulating material is deposited from a direction that is inclined toward the reference direction K with respect to the normal direction of the lower surface LS and a direction that is inclined opposite to the reference direction K. Accordingly, the insulating material is deposited on the side surfaces of the first and second ejection grooves 3*a* and 3*b* and the side surfaces of the first and second non-ejection grooves 4*a* and 4*b* through a part of each of the opening portions 14, the part not being covered by the masks 23, to form the insulating film 19. As illustrated in FIG. 14 (S8-3), the insulating film 19 is formed on the side surfaces of the first and second ejection grooves 3*a* and 3*b* so to be deeper than approximately ¼ of the thickness of the piezoelectric substrate 2, preferably, approximately ⅓ to approximately ½ of the thickness of the piezoelectric substrate 2. When the insulating film 19 is formed to be shallower than approximately ¼ of the thickness of the piezoelectric substrate 2, a drive area defining effect is reduced. On the other hand, when the insulating film 19 is formed to be deeper than approximately ½ of the thickness of the piezoelectric substrate 2, time required for depositing the insulating material is made longer, which results in a reduction in the productivity.

By defining the drive area of each of the side walls 18 in this manner, unnecessary drive areas can be cut. As a result, an electrical efficiency and the deformation of the side walls 18 can be optimized. Further, since the first and second ejection grooves 3*a* and 3*b* are formed by the cutting using a dicing blade, variation is likely to occur in the shapes of the opening portions 14. As a result, variation will occur in the deposition range of the conductive material in the conductive material depositing step S9. By defining the drive area by forming the insulating film 19 as in the present embodiment, it is possible to remove the influence caused by variation in the deposition range of the conductive material. In the present embodiment, the insulating film 19 is formed also on the side surfaces of the first and second non-ejection grooves 4*a* and 4*b*. However, the insulating film 19 formed on the first and second non-ejection grooves 4*a* and 4*b* may be omitted. Further, when the insulating film 19 is not deposited on a part of the lower surface LS and the first and second non-ejection grooves 4*a* and 4*b*, the part being located near the side surface SS, mask 23 having a slit-like opening portion may be used on the outer side with respect to each of the areas R.

Figure 15:
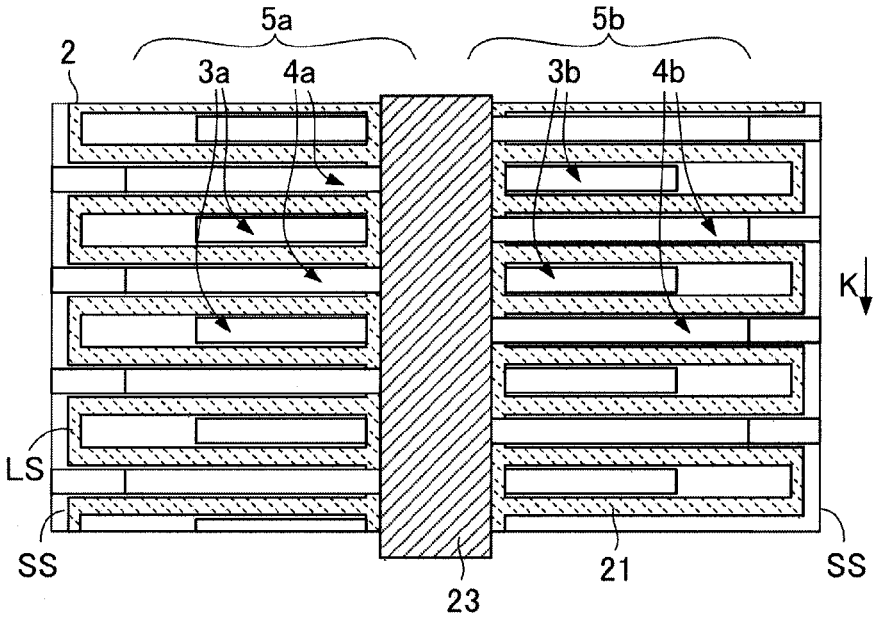
FIG. 15 is a diagram for explaining the steps of the method of manufacturing the liquid jet head according to the sixth embodiment of the present invention.
Figure 15:
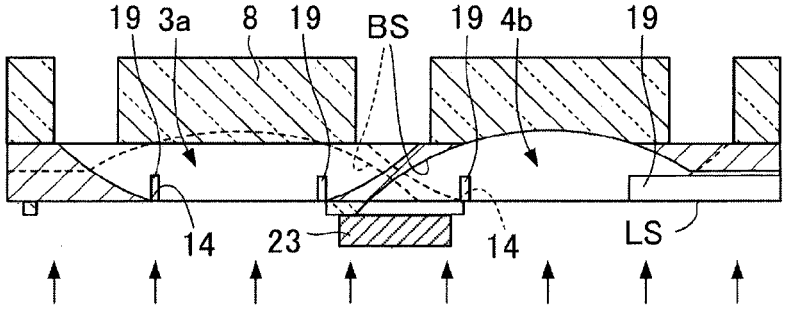
Figure 15:
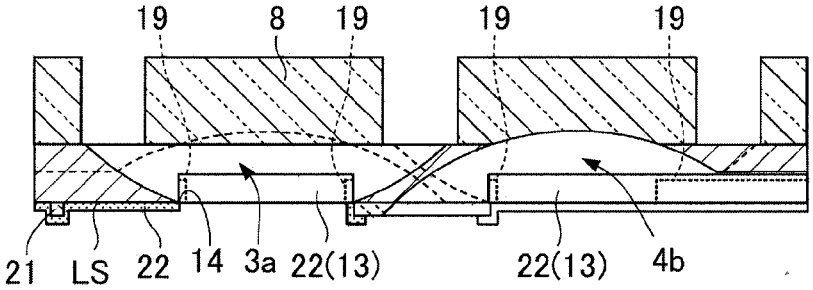

Next, in the conductive material depositing step S9 illustrated in FIG. 15, the conductive material is deposited on the side surfaces of the first and second ejection grooves 3*a* and 3*b* and the side surfaces of the first and second non-ejection grooves 4*a* and 4*b* from the lower surface LS of the piezoelectric substrate 2 to form a conductive film 22. FIG. 15 (S9-1) is a schematic plan view illustrating a state where a mask 23 is placed on the lower surface LS of the piezoelectric substrate 2 before depositing the conductive material thereon when viewed from the underneath of the lower surface LS. FIG. 15 (S9-2) is a schematic cross-sectional view illustrating a state where the conductive material indicated by arrows is obliquely deposited from the underneath of the lower surface LS toward the lower surface LS. FIG. 15 (S9-3) is a schematic cross-sectional view illustrating a state where the conductive film 22 is formed.

As illustrated in FIG. 15 (S9-1), the mask 23 is placed on the lower surface LS so as to cover an area between opening portions 14 in which the first ejection grooves 3*a* of the first groove row 5*a* are open on the lower surface LS and opening portions 14 in which the second ejection grooves 3*b* of the second groove row 5*b* are open on the lower surface LS. In other words, the mask 23 is placed on the lower surface LS of the piezoelectric substrate 2 so as to cover, in the adjacent first and second groove rows 5*a* and 5*b*, the ends facing the second groove row 5*b* of the first non-ejection grooves 4*a* included in the first groove row 5*a* located on the first side and the ends on the first side of the second non-ejection grooves 4*b* included in the second groove row 5*b* located on the second side. Specifically, an end of the mask 23, the end facing the first groove row 5*a*, is placed at a position in the groove direction at which the depth of bottom surfaces BS of the first non-ejection grooves 4*a* from the lower surface LS becomes deeper than approximately ½ of the thickness of the piezoelectric substrate 2. Further, an end of the mask 23, the end facing the second groove row 5*b*, is placed at a position in the groove direction at which the depth of bottom surfaces BS of the second non-ejection grooves 4*b* from the lower surface LS becomes deeper than approximately ½ of the thickness of the piezoelectric substrate 2. More generally, the mask 23 is placed between a position in the groove direction at which the depth of the bottom surfaces BS of the first non-ejection grooves 4*a* becomes deeper than the upper ends of drive electrodes 13 (individual drive electrodes 13*b*) to be formed and a position in the groove direction at which the depth of the bottom surfaces BS of the second non-ejection grooves 4*b* becomes deeper than the upper ends of drive electrodes 13 (individual drive electrodes 13*b*) to be formed. Accordingly, electrical short circuit of the drive electrodes 13 (individual drive electrodes 13*b*) formed on the side surfaces of the first non-ejection grooves 4*a* through the bottom surfaces BS is prevented. The second non-ejection grooves 4*b* are the same as above.

Then, as illustrated in FIG. 15 (S9-2), the conductive material indicated by arrows directing from the lower side toward the upper side is deposited by an oblique deposition method. The conductive material is deposited from a direction that is inclined toward the reference direction K with respect to the normal direction of the lower surface LS and a direction that is inclined opposite to the reference direction K by an oblique deposition method. Accordingly, as illustrated in FIG. 15 (S9-3), the conductive material is deposited on the side surfaces of the first ejection grooves 3*a* and the second non-ejection grooves 4*b* up to a depth approximately ½ of the thickness of the piezoelectric substrate 2, so that the drive electrodes 13 are formed. Further, the conductive material is deposited on a part of the lower surface LS from which the photosensitive resin film 21 is removed and the surface of the photosensitive resin film 21, so that the conductive film 22 is formed. Further, the conductive material is not deposited on the area in which the mask 23 is placed. As the conductive material of the first ejection grooves 3*a*, a metal material such as titanium and aluminum is used. When a chevron type piezoelectric substrate is used as the piezoelectric substrate 2, the conductive film 22 can be deposited on the side surfaces of the first and second ejection grooves 3*a* and 3*b* and the first and second non-ejection grooves 4*a* and 4*b* up to a position deeper than the polarization boundary of the piezoelectric substrate 2.

Figure 16:
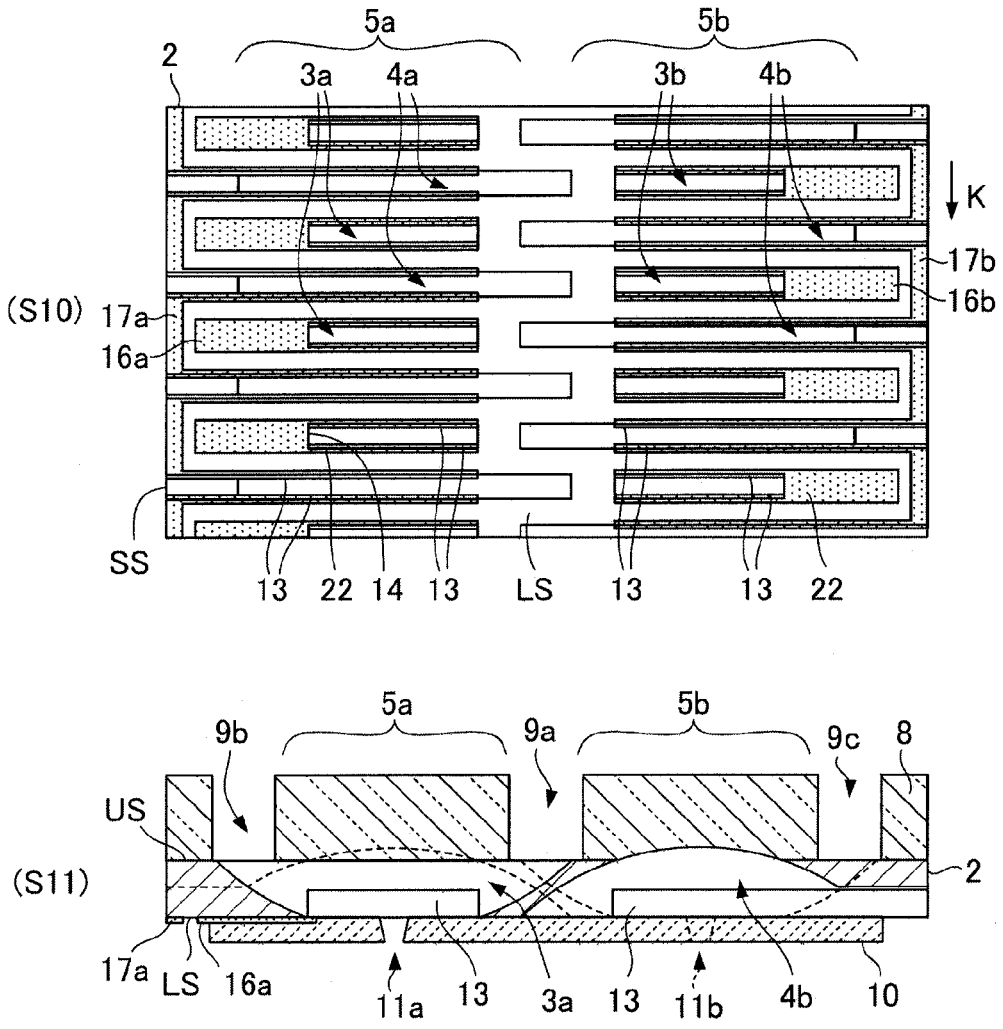
FIG. 16 is a diagram for explaining the steps of the method of manufacturing the liquid jet head according to the sixth embodiment of the present invention.

FIG. 16 (S10) is a schematic plan view of the piezoelectric substrate 2 viewed from the lower surface LS. In the conductive film pattern forming step S10 illustrated in FIG. 16 (S10), a pattern of the conductive film 22 is formed by a lift-off method for removing the photosensitive film 21 from the lower surface LS. As a result, on the side of the first groove row 5*a*, first common terminals 16*a* are formed on the lower surface LS. Each of the common terminals 16*a* is formed between the opening portion 14 of the corresponding first ejection groove 3*a* and the side surface SS, and electrically connected to drive electrodes 13 formed on both side walls of the corresponding first ejection groove 3*a* through intermediate wiring. Further, first individual terminals 17*a* are formed on the first side with respect to the first common terminals 16*a* (between the first common terminals 16*a* and the side surface SS). Each of the first individual terminals 17*a* is electrically connected to two drive electrodes 13 that are formed on side surfaces of two first non-ejection grooves 4*a* between which a first ejection groove 3*a* is interposed, the side surfaces facing the first ejection groove 3*a*. The second groove row 5*b* is the same as above.

Then, in the nozzle plate bonding step S11 illustrated in FIG. 16 (S11), the nozzle plate 10 is bonded to the lower surface LS of the piezoelectric substrate 2 with adhesive to thereby allow nozzles 11*a* and 11*b* formed on the nozzle plate 10 and the first and second ejection grooves 3*a* and 3*b* to communicate with each other. Specifically, the nozzles 11*a* and 11*b* are previously formed at positions corresponding to the first and second ejection grooves 3*a* and 3*b*. Then, the nozzle plate 10 is positioned and bonded to the lower surface LS to thereby allow the nozzles 11*a* and 11*b* to respectively communicate with the first and second ejection grooves 3*a* and 3*b*. Since the first and second ejection grooves 3*a* and 3*b* are open on the lower surface LS, the positioning of the nozzles 11 can be easily performed. Alternatively, the nozzle plate 10 may be first bonded to the lower surface LS of the piezoelectric substrate 2, and the nozzles 11*a* and 11*b* may be thereafter opened to thereby allow the nozzles 11*a* and 11*b* to respectively communicate with the first and second ejection grooves 3*a* and 3*b*. In this case, the width of the nozzle plate 10 is formed to be narrower than the width of the piezoelectric substrate 2 to thereby allow the first and second common terminals 16*a* and 16*b* and the first and second individual terminals 17*a* and 17*b* to be exposed.

By forming the liquid jet head 1 in this manner, it is possible to largely reduce the width of the piezoelectric substrate 2. For example, as in a conventional liquid jet head, when the first groove row 5*a* and the second groove row 5*b* are formed in parallel to each other without allowing the ends of the first ejection grooves 3*a* (second ejection grooves 3*b*) and the ends of the second non-ejection grooves 4*b* (first non-ejection grooves 4*a*) to overlap each other, the width in the groove direction of the piezoelectric substrate 2 is required to be 29 mm. On the other hand, as in the present invention, by allowing the ends of the first ejection grooves 3*a* (second ejection grooves 3*b*) and the ends of the second non-ejection grooves 4*b* (first non-ejection grooves 4*a*) to overlap each other, the width in the groove direction of the piezoelectric substrate 2 can be reduced to 18 mm. Further, in a conventional liquid jet head, it is necessary to form the same number of fine slits as the ejection grooves 3 in the liquid chamber 9 of the cover plate 8. However, fine slits are not required in the present invention. Therefore, in particular, it is possible to cope with a high density pitch of nozzles.

The above manufacturing method is an example of the present invention. For example, the non-ejection forming step S2 may be performed first, and the ejection groove forming step S1 may be performed thereafter. Further, the conductive material depositing step S9 for depositing the conductive film 22 from the upper surface US of the piezoelectric substrate 2 may be performed after the ejection groove forming step S1 and the non-ejection groove forming step S2. In this case, the common terminals 16*a* and 16*b* and the individual terminals 17*a* and 17*b* are formed on the upper surface US of the piezoelectric substrate 2. Further, in the above embodiment, the example in which the two groove rows, namely, the first and second groove rows 5*a* and 5*b* are formed has been described. However, the present invention is not limited to the two groove rows. For example, a liquid jet head 1 having three or four groove rows may be formed. The larger the number of groove rows is, the more the number of piezoelectric substrates obtained from a single piezoelectric wafer is increased. As a result, the manufacturing cost can be reduced.

Seventh Embodiment

Figure 17:
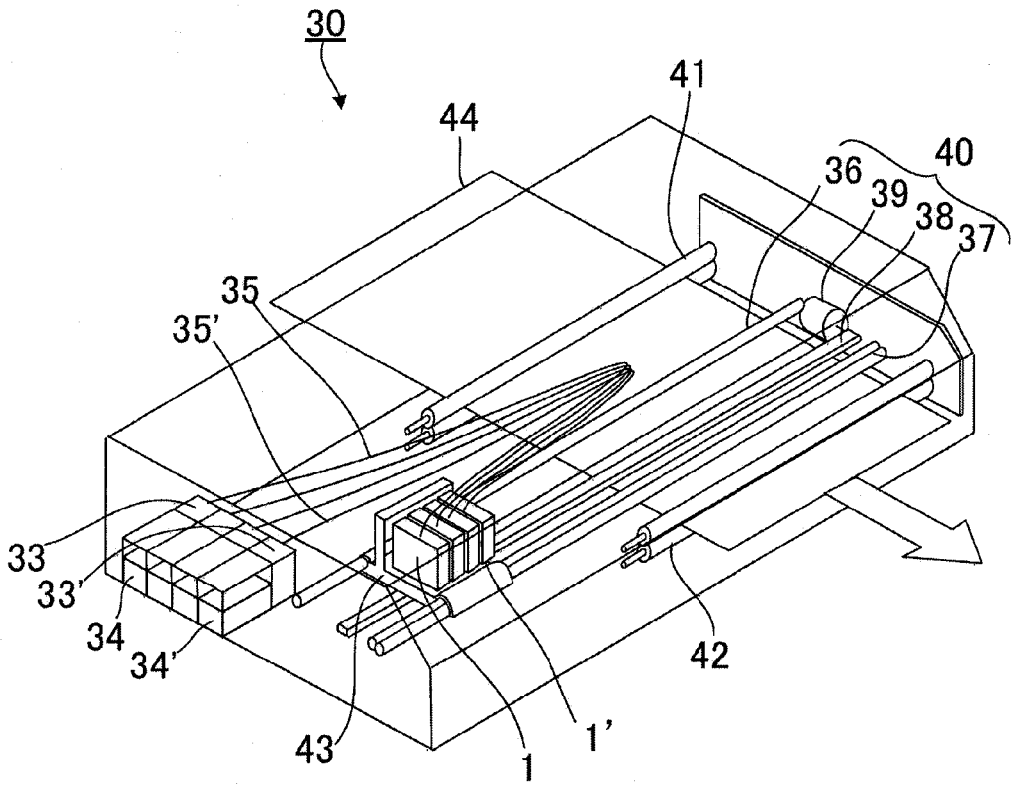
FIG. 17 is a schematic perspective view of a liquid jet apparatus according to a seventh embodiment of the present invention.
Figure 18A:
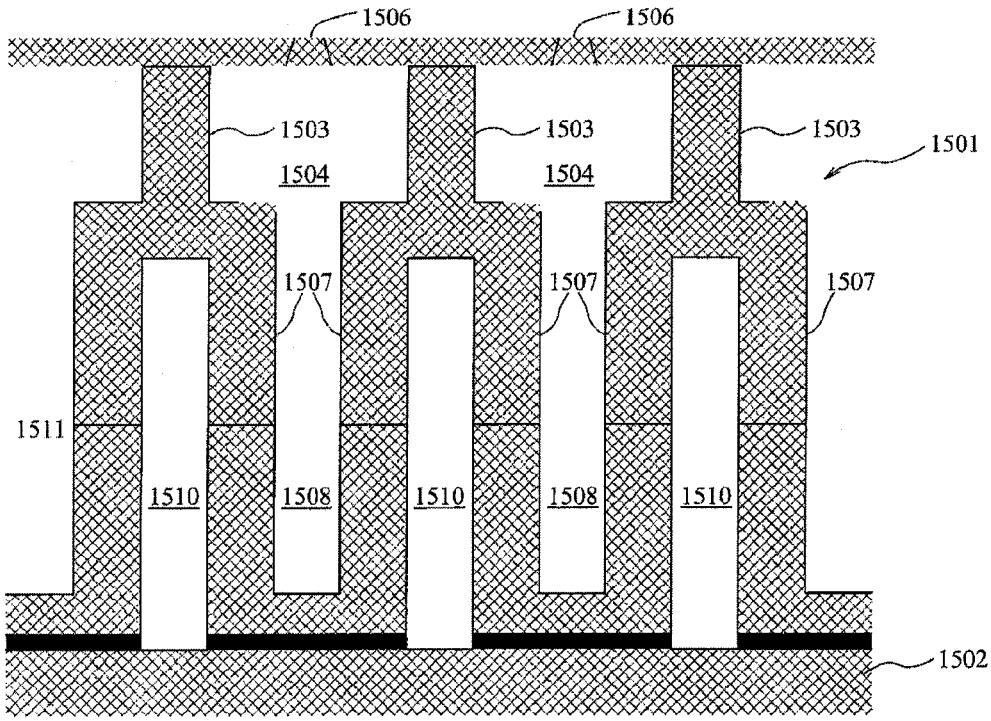
Fig.18A Prior art
FIGS. 18A and 18B are explanatory drawings of a conventionally-known liquid jet head.
Figure 18B:
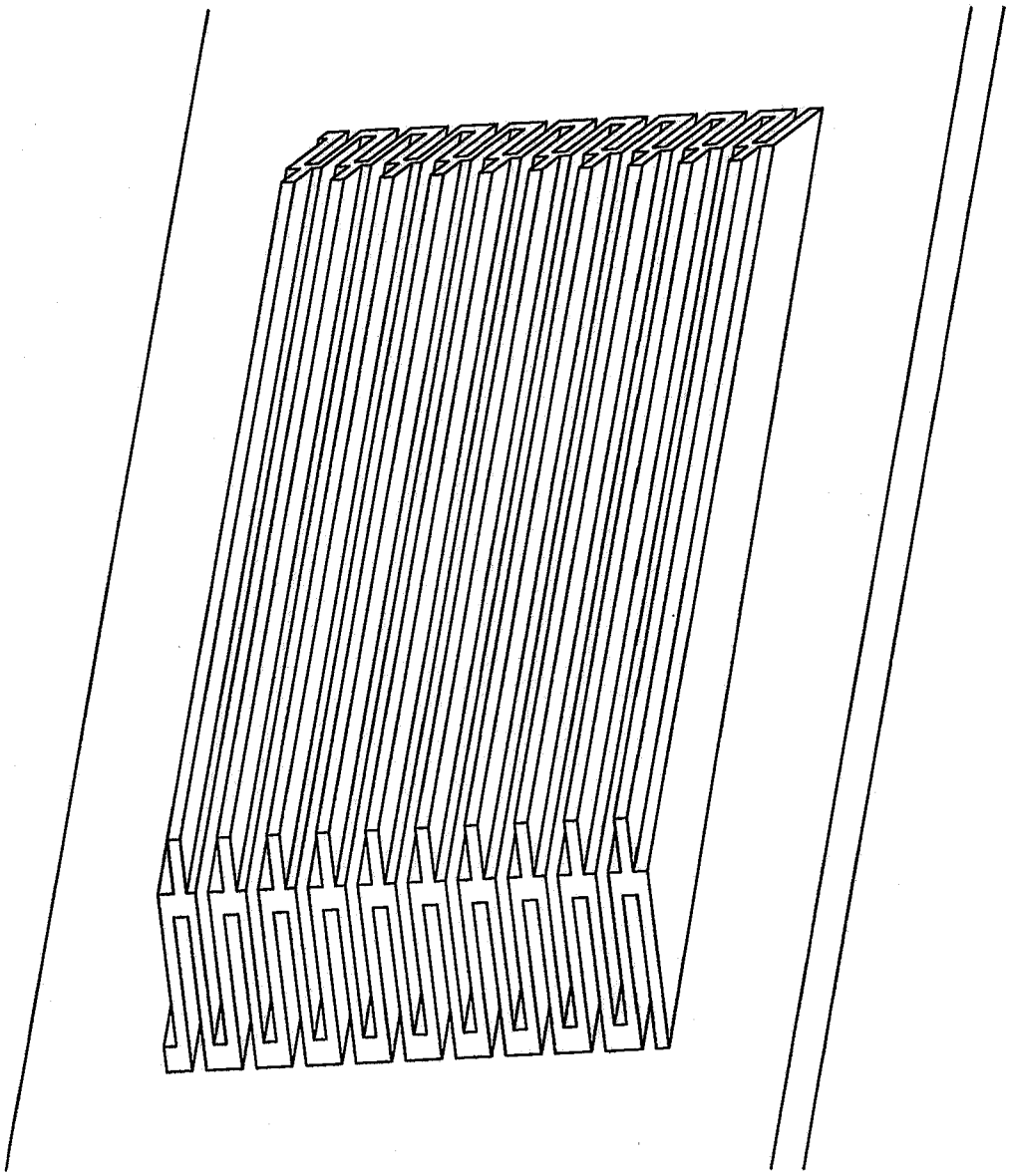
Fig.18B Prior art

FIG. 17 is a schematic perspective view of a liquid jet apparatus 30 according to the seventh embodiment of the present invention. The liquid jet apparatus 30 is provided with a movement mechanism 40 which reciprocates liquid jet heads 1 and 1', flow path sections 35 and 35' which respectively supply liquid to the liquid jet heads 1 and 1' and discharge liquid from the liquid jet heads 1 and 1', and liquid pumps 33 and 33' and liquid tanks 34 and 34' which respectively communicate with the flow path sections 35 and 35'. Each of the liquid jet heads 1 and 1' is provided with a plurality of groove rows. Further, ends on the second side of ejection grooves included in a groove row located on the first side and ends on the first side of non-ejection grooves included in a groove row located on the second side are separated from each other, and overlap each other in the thickness direction of a piezoelectric substrate. As each of the liquid jet heads 1 and 1', any one of the above-described liquid jet heads of the first to sixth embodiments is used.

The liquid jet apparatus 30 is provided with a pair of conveyance units 41 and 42 which conveys a recording medium 44 such as paper in a main scanning direction, the liquid jet heads 1 and 1' each of which ejects liquid onto the recording medium 44, a carriage unit 43 on which the liquid jet heads 1 and 1' are loaded, the liquid pumps 33 and 33' which respectively supply liquid stored in the liquid tanks 34 and 34' to the flow path sections 35 and 35' by pressing, and the movement mechanism 40 which moves the liquid jet heads 1 and 1' in a sub-scanning direction that is perpendicular to the main scanning direction. A control unit (not illustrated) controls the liquid jet heads 1 and 1', the movement mechanism 40, and the conveyance units 41 and 42 to drive.

Each of the pair of conveyance units 41 and 42 extends in the sub-scanning direction, and includes a grid roller and a pinch roller which rotate with the roller surfaces thereof making contact with each other. The grid roller and the pinch roller are rotated around the respective shafts by a motor (not illustrated) to thereby convey the recording medium 44, which is sandwiched between the rollers, in the main scanning direction. The movement mechanism 40 is provided with a pair of guide rails 36 and 37 each of which extends in the sub-scanning direction, the carriage unit 43 which can slide along the pair of guide rails 36 and 37, an endless belt 38 to which the carriage unit 43 is coupled to move the carriage unit 43 in the sub-scanning direction, and a motor 39 which revolves the endless belt 38 via a pulley (not illustrated).

The carriage unit 43 loads the plurality of liquid jet heads 1 and 1' thereon. The liquid jet heads 1 and 1' eject, for example, liquid droplets of four colors including yellow, magenta, cyan, and black. Each of the liquid tanks 34 and 34' stores liquid of corresponding color, and supplies the stored liquid to each of the liquid jet heads 1 and 1' through each of the liquid pumps 33 and 33' and each of the flow path sections 35 and 35'. Each of the liquid jet heads 1 and 1' ejects liquid droplets of corresponding color in response to a driving signal. Any patterns can be recorded on the recording medium 44 by controlling the timing of ejecting liquid from the liquid jet heads 1 and 1', the rotation of the motor 39 for driving the carriage unit 43, and the conveyance speed of the recording medium 44.

In the liquid jet apparatus 30 of the present embodiment, the movement mechanism 40 moves the carriage unit 43 and the recording medium 44 to perform recording. Alternatively, however, the liquid jet apparatus may have a configuration in which a carriage unit is fixed, and a movement mechanism two-dimensionally moves a recording medium to perform recording. That is, the movement mechanism may have any configuration as long as it can relatively move a liquid jet head and a recording medium.

What is claimed is:

1. A liquid jet head comprising:

a piezoelectric substrate having opposite side surfaces and having first and second groove rows each comprised of elongated ejection grooves and elongated non-ejection grooves alternately arranged in a reference direction, the first and second groove rows being arranged next to each other in the longitudinal direction of the grooves so that grooves in the first groove row are longitudinally displaced relative to grooves in the second groove row, the grooves having opposite first and second ends, and the first ends of the grooves being located closer than the second ends to one side surface of the piezoelectric plate and the second ends of the grooves being located closer than the first ends to the other side surface of the piezoelectric plate, wherein end portions of the second ends of ejection grooves in the first groove row and end portions of the first ends of non-ejection grooves in the second groove row are separated from each other, and overlap each other in a thickness direction of the piezoelectric substrate.

2. The liquid jet head according to claim 1, wherein end portions of the second ends of ejection grooves in the first groove row and end portions of the first ends of ejection grooves in the second groove row overlap each other in the reference direction.

3. The liquid jet head according to claim 1, wherein end portions of the second ends of non-ejection grooves in the first groove row and end portions of the first ends of non-ejection grooves in the second groove row overlap each other in the reference direction.

4. The liquid jet head according to claim 1, wherein end portions of the second ends of ejection grooves in the first groove row include inclined surfaces inclined outward toward an upper surface of the piezoelectric substrate, and end portions of the first ends of non-ejection grooves in the second groove row include inclined surfaces inclined outward toward a lower surface opposite to the upper surface of the piezoelectric substrate.

5. The liquid jet head according to claim 1, wherein the first ends of non-ejection grooves in the first groove row open on one side surface of the piezoelectric plate and the second ends of non-ejection grooves in the second groove row open on the other side surface of the piezoelectric substrate.

6. The liquid jet head according to claim 1, wherein the closest distance between the second ends of ejection grooves in the first groove row and the first ends of non-ejection grooves in the second groove row is not less than 10 μm.

7. The liquid jet head according to claim 1, further comprising a cover plate having a liquid chamber communicating with the ejection grooves, the cover plate being bonded to the upper surface of the piezoelectric substrate.

8. The liquid jet head according to claim 7, wherein the liquid chamber includes a common liquid chamber communicating with the second ends of ejection grooves in the first groove row.

9. The liquid jet head according to claim 7, wherein the liquid chamber includes an individual liquid chamber communicating with the first ends of the ejection grooves in the first groove row.

10. The liquid jet head according to claim 1, further comprising a nozzle plate having a plurality of nozzle arrays in each of which nozzles communicating with the ejection grooves are arrayed corresponding to the groove rows, the nozzle plate being bonded to a lower surface of the piezoelectric substrate.

11. The liquid jet head according to claim 1, wherein drive electrodes are formed on side surfaces of the ejection grooves and the non-ejection grooves not in a part between a position corresponding to approximately ½ of the thickness of the piezoelectric substrate and an upper surface, but in a part between the position corresponding to approximately ½ of the thickness of the piezoelectric substrate and a lower surface.

12. The liquid jet head according to claim 11, wherein drive electrodes formed on the ejection grooves are positioned within an area of opening portions in which the ejection grooves are open on the lower surface of the piezoelectric substrate in the groove direction.

13. The liquid jet head according to claim 1, wherein drive electrodes are formed on side surfaces of the ejection grooves and the non-ejection grooves not in a part between a position corresponding to approximately ½ of the thickness of the piezoelectric substrate and a lower surface, but in a part between the position corresponding to approximately ½ of the thickness of the piezoelectric substrate and an upper surface.

14. The liquid jet head according to claim 13, wherein drive electrodes formed on the non-ejection grooves are positioned within an area of opening portions in which the non-ejection grooves are open on the upper surface of the piezoelectric substrate in the groove direction.

15. A liquid jet apparatus comprising:

the liquid jet head according to claim 1;

a movement mechanism configured to relatively move the liquid jet head and a recording medium;

a liquid supply tube configured to supply liquid to the liquid jet head; and a liquid tank configured to supply the liquid to the liquid supply tube.

* * * * *